US008151940B2

(12) United States Patent
Gordon et al.

(10) Patent No.: US 8,151,940 B2
(45) Date of Patent: Apr. 10, 2012

(54) EVACUATION SYSTEMS AND METHODS

(75) Inventors: Tal Gordon, Hod Hasharon (IL); Eyal Moses, Tel Aviv (IL)

(73) Assignee: Escape Rescue Systems, Ltd., Tal Mond (IL)

( * ) Notice: Subject to any disclaimer, the term of this patent is extended or adjusted under 35 U.S.C. 154(b) by 1831 days.

(21) Appl. No.: 10/531,097

(22) PCT Filed: Oct. 8, 2003

(86) PCT No.: PCT/IL03/00809

§ 371 (c)(1),
(2), (4) Date: Aug. 4, 2005

(87) PCT Pub. No.: WO2004/033043

PCT Pub. Date: Apr. 22, 2004

(65) Prior Publication Data

US 2006/0054420 A1 Mar. 16, 2006

Related U.S. Application Data

(60) Provisional application No. 60/416,986, filed on Oct. 8, 2002.

(51) Int. Cl.
*B66B 9/00* (2006.01)

(52) U.S. Cl. ..... 187/239; 187/401; 187/900; 182/37; 182/36

(58) Field of Classification Search ..... 182/36, 182/63, 102, 115, 141, 142, 144, 150, 156, 182/178.1, 196, 37; 187/313, 239–242, 277, 391, 393, 401, 900
See application file for complete search history.

(56) References Cited

U.S. PATENT DOCUMENTS

| | | | | |
|---|---|---|---|---|
| 3,650,356 | A | 3/1972 | Brown | |
| 3,907,066 | A | 9/1975 | Newton | |
| 3,945,469 | A | 3/1976 | Dorcich | |
| 3,954,185 | A | 5/1976 | Wentz | |
| 4,000,789 | A | 1/1977 | Zahner | |
| 4,018,306 | A | 4/1977 | Lyons | |
| 4,037,685 | A | 7/1977 | Talucci | |
| 4,042,066 | A | 8/1977 | Noone | |
| 4,068,738 | A | 1/1978 | Reed | |
| 4,162,717 | A * | 7/1979 | Orii et al. | 182/48 |
| 4,168,748 | A * | 9/1979 | Batte | 169/46 |
| 4,234,055 | A | 11/1980 | Beeche | |
| 4,253,548 | A | 3/1981 | Beeche | |

(Continued)

FOREIGN PATENT DOCUMENTS

EP 0142963 5/1985

(Continued)

OTHER PUBLICATIONS

International Search Report dated Feb. 23, 2006 (4 pages).

*Primary Examiner* — Eduardo Colon Santana
(74) *Attorney, Agent, or Firm* — Fish & Richardson P.C.

(57) ABSTRACT

An evacuation system for a building including at least one selectably lowerable, collapsible, generally vertical transporter arranged for selectable communication with at least one floor of a building and a controller for selectably lowering at least one platform of the transporter from the at least one floor to a level at which egress of persons may safely occur.

29 Claims, 37 Drawing Sheets

U.S. PATENT DOCUMENTS

| | | | | | |
|---|---|---|---|---|---|
| 4,270,628 | A | | 6/1981 | Anderson | |
| 4,406,351 | A | | 9/1983 | Littlejohn et al. | |
| 4,424,884 | A | | 1/1984 | Smith, Jr. | |
| 4,469,198 | A | | 9/1984 | Crump | |
| 4,531,611 | A | | 7/1985 | Curiel | |
| 4,538,704 | A | | 9/1985 | Forrest | |
| 4,553,636 | A | | 11/1985 | Itoh et al. | |
| 4,569,418 | A | | 2/1986 | Novarini | |
| 4,640,384 | A | * | 2/1987 | Kucher et al. | 182/51 |
| 4,650,036 | A | | 3/1987 | Matsuda | |
| 4,664,226 | A | | 5/1987 | Centanne | |
| 4,705,140 | A | | 11/1987 | Dudley et al. | |
| 4,732,235 | A | * | 3/1988 | Reed | 182/142 |
| 4,830,141 | A | * | 5/1989 | Montaigne | 182/82 |
| 4,865,155 | A | * | 9/1989 | Montaigne et al. | 182/14 |
| 4,919,228 | A | | 4/1990 | Stefan | |
| 5,065,839 | A | | 11/1991 | Napier | |
| 5,127,491 | A | | 7/1992 | Just-Buddy | |
| 5,377,778 | A | | 1/1995 | Lan | |
| 5,392,877 | A | | 2/1995 | Shahin et al. | |
| 5,497,855 | A | | 3/1996 | Moore | |
| 5,498,011 | A | | 3/1996 | Kilada et al. | |
| 5,597,987 | A | | 1/1997 | Gilliland et al. | |
| 5,620,058 | A | | 4/1997 | Forrester | |
| 5,660,249 | A | | 8/1997 | Powell et al. | |
| 6,318,503 | B1 | | 11/2001 | Hernandez | |
| 6,467,575 | B1 | * | 10/2002 | Chen | 182/48 |
| 6,598,703 | B1 | * | 7/2003 | Catalan | 182/48 |
| 6,620,058 | B2 | | 9/2003 | Halko et al. | |
| 6,684,978 | B1 | * | 2/2004 | Gupta | 182/48 |
| 6,910,552 | B2 | * | 6/2005 | Nir | 182/48 |
| 7,048,092 | B2 | * | 5/2006 | Gomes Junior | 182/48 |
| 7,188,705 | B1 | * | 3/2007 | Fuhrmann | 182/48 |
| 2004/0118635 | A1 | * | 6/2004 | Sun et al. | 182/142 |
| 2004/0154869 | A1 | | 8/2004 | May | |
| 2004/0178022 | A1 | * | 9/2004 | Futiran et al. | 187/277 |
| 2004/0256179 | A1 | | 12/2004 | Deplazes et al. | |
| 2008/0035425 | A1 | * | 2/2008 | Meitus et al. | 182/129 |
| 2008/0190704 | A1 | * | 8/2008 | Moses et al. | 187/247 |

FOREIGN PATENT DOCUMENTS

| | | | | |
|---|---|---|---|---|
| GB | 1 434 366 | | | 5/1976 |
| GB | 1434366 | A | * | 5/1976 |
| GB | 2 099 789 | | | 12/1982 |
| GB | 2 230 814 | | | 10/1990 |
| JP | 10248945 | A | * | 9/1998 |
| JP | 2002360716 | A | * | 12/2002 |
| SU | 1251920 | A1 | * | 8/1986 |

* cited by examiner

EVACUATION SYSTEMS AND METHODS

REFERENCE TO CO-PENDING APPLICATIONS

Applicant hereby claims priority of U.S. Provisional Patent Application Ser. No. 60/416,986, filed Oct. 8, 2002, entitled "ESCAPE DEVICE FOR USE IN HIGH RISE BUILDINGS".

FIELD OF THE INVENTION

The present invention relates to building evacuation systems and methods, and more particularly to high-rise building evacuation systems and methods.

BACKGROUND OF THE INVENTION

The following U.S. Patents are believed to represent the current state of the art:

U.S. Pat. Nos. 3,945,469; 4,018,306; 4,037,685; 4,042,066; 4,406,351; 4,424,884; 4,469,198; 4,531,611; 4,538,704; 4,569,418; 4,650,036; 4,664,226; 4,830,141; 4,865,155; 4,919,228; 5,065,839; 5,127,491; 5,377,778; 5,392,877; 5,497,855; 5,620,058 and 6,318,503.

SUMMARY OF THE INVENTION

The present invention seeks to provide improved building evacuation systems and methods.

There is thus provided in accordance with a preferred embodiment of the present invention an evacuation system for a building including at least one selectably lowerable, collapsible, generally vertical transporter arranged for selectable communication with at least one floor of a building and a controller for selectably lowering at least one platform of the transporter from the at least one floor to a level at which egress of persons may safely occur.

There is also provided in accordance with another preferred embodiment of the present invention an evacuation system for a building including at least one selectably lowerable, multiple-platform, generally vertical transporter arranged for selectable communication with multiple floors of a building and a controller for selectably lowering the multiple platforms of the at least one transporter from the multiple floors to at least one egress level at which egress of persons may safely occur.

There is further provided in accordance with yet another preferred embodiment of the present invention an evacuation system for a building including at least one, selectably lowerable, selectably mutually spacable, multiple-platform, generally vertical transporter arranged for selectable communication with multiple floors of a building and a controller for selectably lowering the multiple platforms of the transporter from the multiple floors to a level at which egress of persons may safely occur, mutual spacing between the multiple platforms being reducible when they are not holding persons.

In accordance with another preferred embodiment or the present invention the at least one transporter includes a multiple-platform transporter, arranged for selectable communication with multiple floors of a building. Additionally, the at least one selectably lowerable, multiple-platform, generally vertical transporter includes a plurality of stackable platforms arranged to be supported on multiple generally vertical supports, at least some of the plurality of stackable platforms being arranged in mutually spaced relationship, each in communication with a different floor of the building for evacuation loading. Preferably, the plurality of stackable platforms are arranged in a mutually collapsed relationship when not in use. Additionally, the plurality of stackable platforms are arranged in a mutually collapsed relationship following evacuation unloading.

In accordance with still another preferred embodiment of the present invention the multiple generally vertical supports include cables. Alternatively, the multiple generally vertical supports include rigid support elements.

In accordance with yet another preferred embodiment of the present invention the plurality of stackable platforms each include a bottom support surface and a peripheral enclosing element. Preferably, the peripheral enclosing element includes a wall element formed of fabric. Additionally, the fabric includes at least one of a heat resistant fabric, a fire resistant fabric and a smoke resistant fabric.

In accordance with still another preferred embodiment of the present invention the evacuation system also includes at least one building mounted stabilizing element cooperating with the transporter for stabilizing the transporter against lateral forces.

In accordance with another preferred embodiment of the present invention the at least one transporter includes a plurality of transporters and the controller is operative to individually control individual ones of the plurality of transporters wherein multiple platforms of different transporters may be simultaneously positioned in communication with different groups of multiple floors of the building for simultaneous evacuation loading. Additionally or alternatively, the controller is operative to simultaneously position the multiple platforms in communication with multiple egress levels of the building for simultaneous evacuation.

In accordance with yet another preferred embodiment of the present invention the at least one transporter is also operative for lifting persons from the at least one egress level to the multiple floors of the building.

In accordance with still another preferred embodiment of the present invention the transporter is building mounted. Additionally, the controller is operative to selectably lower the at least one platform to the egress level in the absence of electrical power. Alternatively, the transporter is portable. In accordance with still another preferred embodiment of the present invention the portable transporter is raised and lowered by a telescopic piston.

In accordance with yet another preferred embodiment of the present invention the multiple platforms include nestable platforms.

There is yet further provided in accordance with still another preferred embodiment of the present invention a method for evacuation of a building including selectably positioning at least one selectably lowerable, collapsible, generally vertical transporter in communication with at least one floor of a building and selectably lowering the at least one platform of the at least one transporter from the at least one floor to at least one egress level at which egress of persons may safely occur.

There is even further provided in accordance with yet another preferred embodiment of the present invention a method for evacuation of a building including selectably positioning at least one selectably lowerable, multiple-platform, generally vertical transporter in communication with multiple floors of a building and selectably lowering the multiple platforms of the at least one transporter from the multiple floors to at least one egress level at which egress of persons may safely occur.

There is also provided in accordance with another preferred embodiment of the present invention a method for evacuation of a building including selectably positioning at least one, selectably lowerable, selectably mutually spacable, multiple-platform, generally vertical transporter in communication with multiple floors of a building, selectably lowering the multiple platforms of the transporter from the multiple floors to a level at which egress of persons may safely occur and reducing mutual spacing between the multiple platforms following the egress of persons.

In accordance with another preferred embodiment of the present invention the at least one transporter includes a multiple-platform transporter and the selectably positioning includes selectably positioning the multiple platforms in communication with multiple floors of a building.

In accordance with still another preferred embodiment of the present invention the method also includes stabilizing the transporter against lateral forces.

In accordance with yet another preferred embodiment of the present invention the at least one transporter includes a plurality of transporters and the selectably positioning includes simultaneously positioning individual ones of the plurality of transporters wherein multiple platforms of different transporters are in communication with different groups of multiple floors of the building for simultaneous evacuation loading. Additionally or alternatively, the method also includes simultaneously positioning the multiple platforms in communication with multiple egress levels of the building for simultaneous evacuation.

In accordance with yet another preferred embodiment of the present invention the selectably positioning includes selectably positioning a plurality of stackable platforms, each in communication with a different floor of the building for evacuation loading.

There is further provided in accordance with yet another preferred embodiment of the present invention a method for simultaneously lifting people to multiple levels of a building including selectably positioning at least one selectably liftable, multiple-platform, generally vertical transporter in communication with an ingress level of a building and selectably lifting the multiple platforms of the at least one transporter to multiple floors of the building.

In accordance with another preferred embodiment of the present invention the selectably positioning includes sequentially positioning a plurality of stackable platforms, each in communication with the ingress level.

In accordance with still another preferred embodiment of the present invention the method also includes stabilizing the transporter against lateral forces.

In accordance with still another preferred embodiment of the present invention the method also includes simultaneously positioning the multiple platforms in communication with multiple ingress levels of the building for simultaneous loading.

BRIEF DESCRIPTION OF THE DRAWINGS

The present invention will be understood and appreciated more fully from the following detailed description, taken in conjunction with the drawings in which:

FIGS. 2A, 2B, 2C, 2D, 2E, 2F, 2G, 2H, 2I, 2J, 2K, 2L, 2M, 2N, 2O, 2P, 2Q, 2R, 2S, 2T, 2U, 2V and 2W illustrate sequential stages in the operation of an escape transporter in the system of FIG. 1 and some variations thereof;

DETAILED DESCRIPTION OF PREFERRED EMBODIMENTS

Figure 1:
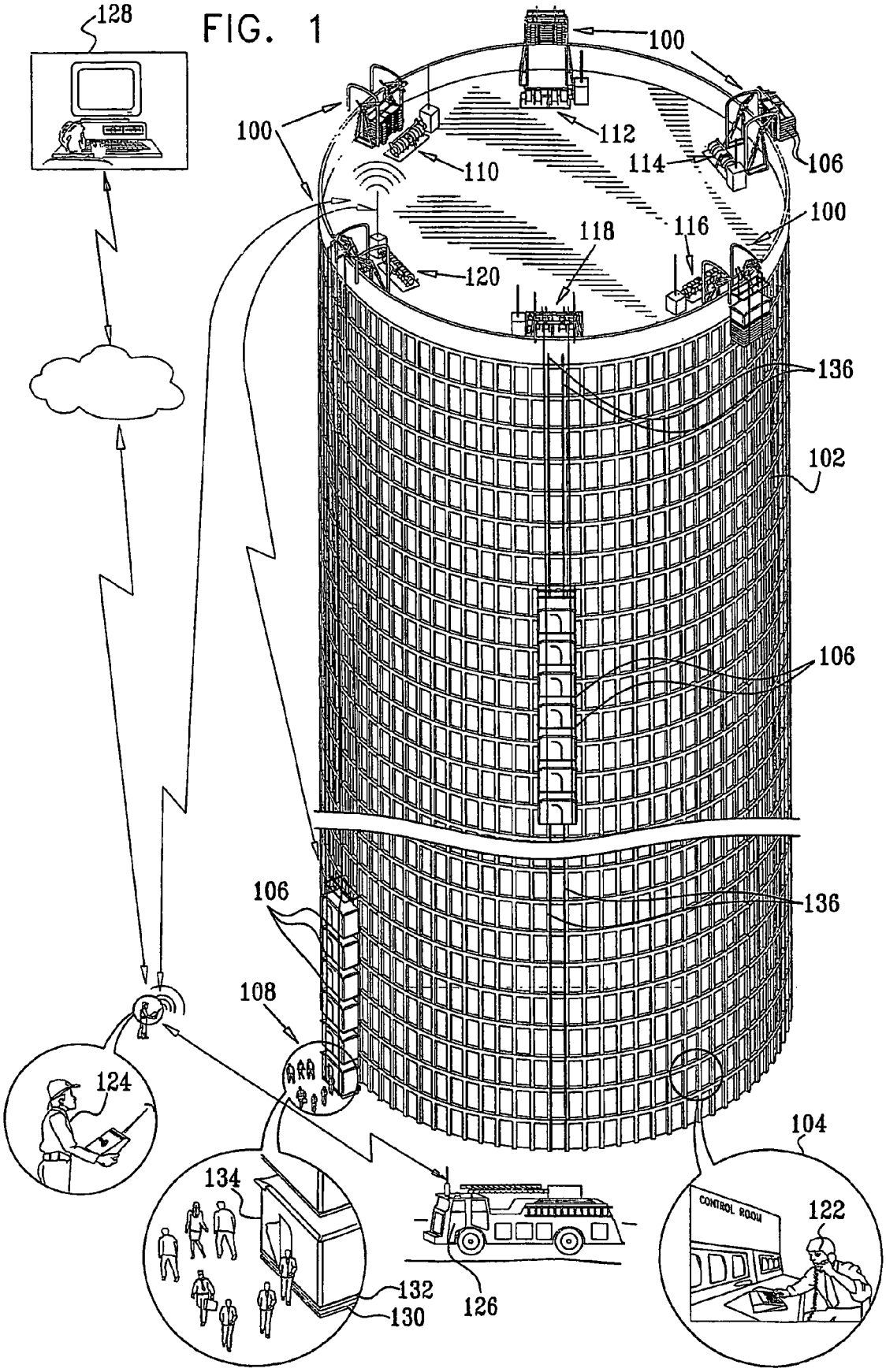
FIG. 1 is a simplified pictorial illustration of a building equipped with an escape system constructed and operative in accordance with a preferred embodiment of the present invention.

Reference is now made to FIG. 1, which is a simplified pictorial illustration of a building equipped with an escape system constructed and operative in accordance with a preferred embodiment of the present invention. As seen in FIG. 1, there is provided an evacuation system for a building preferably comprising a plurality of selectably lowerable, multiple-platform, generally vertical transporters generally designated by reference numerals 100, each arranged for selectable communication with multiple floors of a building 102. Control outputs preferably provided by a central controller 104 or alternatively by multiple controllers, each assignable to a given transporter 100, selectably lower multiple platforms 106 of the transporters 100 from multiple floors to at least one egress level 108 at which egress of persons may safely occur.

It is appreciated that a given building, such as building 102, may include one or more transporters 100. In the illustrated embodiment of FIG. 1, multiple transporters 100 are shown in various operative orientations. For example, a transporter designated 110 is shown in a storage orientation, a transporter 112 is shown in an initial pre-deployment orientation, a transporter 114 is shown in an advanced pre-deployment orientation; a transporter 116 is shown in an initial deployment orientation, a transporter 118 is shown in an evacuation ingress orientation; and a transporter 120 is shown in an evacuation egress orientation.

Human control inputs to controller 104 or directly to transporters 100 may be provided, for example, by one or more of an operator 122 at the controller 104, an operator 124 on the ground, an operator in a fire engine 126 and a remote operator 128, communicating via a data network, such as the Internet or an emergency network.

As seen in FIG. 1, each of the transporters 100 preferably comprises a plurality of stackable platforms 106, arranged to be supported on multiple generally vertical supports, the plurality of stackable platforms 106 being arranged in mutually spaced relationship, as illustrated in FIG. 1 for transporter 118, each in communication with a different floor of building 102 for evacuation loading. The plurality of stackable platforms 106 are preferably arranged in a mutually collapsed relationship when not in use, as illustrated in FIG. 1 for transporters 110, 112, 114 and 116.

Following egress of evacuated persons from platforms 106, the stackable platforms 106 are arranged in a mutually collapsed relationship, as indicated by reference numeral 130.

In the illustrated embodiment of FIG. 1, each of the plurality of stackable platforms 106 preferably comprises a bottom support surface 132 and a peripheral enclosing element 134, such as a wall element formed of fabric, preferably a heat resistant, fire resistant and/or smoke resistant fabric, or formed of mutually foldable rigid elements or any suitable combination thereof. Enclosing element 134 may constitute a protective railing or restraining band rather than a complete wall. Enclosing element 134 is preferably designed to provide low aerodynamic drag to reduce wind force on the platform 106. Preferably at least one building mounted stabilizing element cooperates with each transporter for stabilizing the transporter against lateral forces, such as wind forces. In the illustrated embodiment, vertical guides 136 are provided at suitable locations along building 102.

In the embodiment of FIG. 1, where a plurality of transporters 100 are provided, the controller 104 is preferably operative to individually control individual transporters 100 such that multiple platforms 106 of different transporters may be simultaneously positioned in communication with different groups of multiple floors of the building for simultaneous evacuation loading. The multiple floors may or may not be contiguous.

The transporters may also be employed for lifting persons, such as firefighters or other rescue personnel, and/or equipment, from the egress level or other building levels to multiple levels of the building.

Figure 2A:
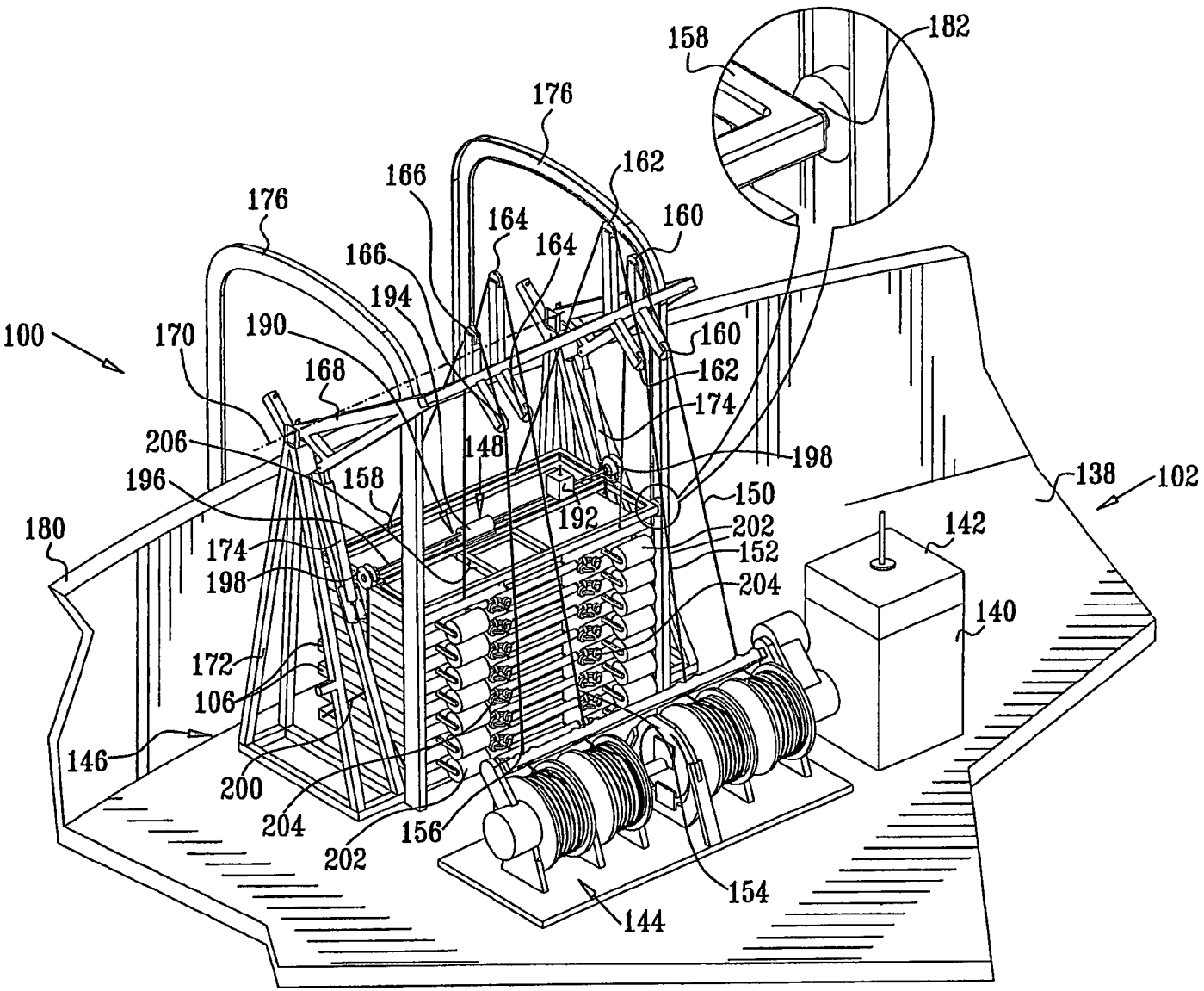

Reference is now made to FIGS. 2A, 2B, 2C, 2D, 2E, 2F, 2G, 2H, 2I, 2J, 2K, 2L, 2M, 2N, 2O, 2P, 2Q, 2R, 2S, 2T, 2U, 2V & 2W, which illustrate typical operation of the evacuation system of FIG. 1. Turning to FIG. 2A, it is seen that a typical transporter 100 includes a fixed installation, preferably mounted onto the roof 138 of building 102. The fixed installation preferably includes a transporter control subsystem 140 having a wired and/or wireless communication interface 142 and being arranged for interactive data communication with controller 104 (FIG. 1) and/or one or more communicators (not shown) employed by one or more operators, such as operators 122, 124 and 128 (FIG. 1).

Transporter control subsystem 140 operates, using mains power, emergency back-up power and/or a generator, a winch/brake assembly 144, which is preferably hydraulic, a stacked platform pre-deployment positioning assembly 146 and a platform deployment assembly 148. Preferably, winch/brake assembly 144 includes a conventional hydraulic fluid pump and reservoir assembly, a conventional hydraulic cooling assembly, a conventional hydraulic gear motor assembly and a conventional hydraulic control valve (not shown), which provide power and braking for conventional hydraulic winches associated therewith as well as an emergency hydraulic braking system. Preferably, winch/brake assembly 144 provides braking while transporters 100 are descending and provides a lifting power when transporters 100 are ascending.

It is appreciated that in the absence of electrical power, winch/brake assembly 144 is operative to lower platforms 106 of transporter 100 to egress level 108 (FIG. 1) using gravitational force.

Preferably four cables 150, 152, 154 and 156 are wound on winch/brake assembly 144 and extend to four mutually spaced locations on a transporter top frame 158. Each of cables 150, 152, 154 and 156 preferably engages a pair of pulleys, here respectively designated by reference numerals 160, 162, 164 and 166, supported onto a pivotably mounted deployment frame 168. Deployment frame 168 is pivotably mounted for rotation about an axis 170 defined by a static support frame 172. Selectable pivotal orientation of deployment frame 168 preferably is provided by a pair of hydraulic pistons 174.

A pair of mutually spaced deployment tracks 176 extends in an arc from building roof 138, initially vertically and then over a roof wall 180 and downward in spaced relationship with an outside surface thereof. Transporter top frame 158 is arranged to ride along tracks 176 and preferably includes a pair of rollers 182 at corners thereof, which ridingly engage tracks 176.

Turning to the platform deployment assembly 148, it is seen that mounted onto transporter top frame 158 is a stacked platform selectable release assembly 190, which preferably comprises a wireless control communicator 192 which, inter alia, governs the operation of a stacked platform selectable release motor/brake assembly 194 which operates a rotatable shaft 196, onto ends of which are mounted pulleys 198. Preferably cables 200 are wound onto pulleys 198. These cables are coupled to the lowest platform 106 such that deployment of platforms 106 is governed by motor/brake assembly 194.

FIG. 2A shows a plurality of stacked platforms 106 held tightly below transporter top frame 158 by cables 200. Each of the stacked platforms 106 is seen to preferably include a pair of shock absorbing rollers 202 and a pair of building mounted guide riding roller assemblies 204, which are adapted for vertically slidable operative engagement with building mounted vertical rails or guides, such as building mounted vertical guides 136 (FIG. 1). As will be described hereinbelow in greater detail, each of the stacked platforms 106 includes a selectably positionable evacuation bridge 206.

Figure 2B:
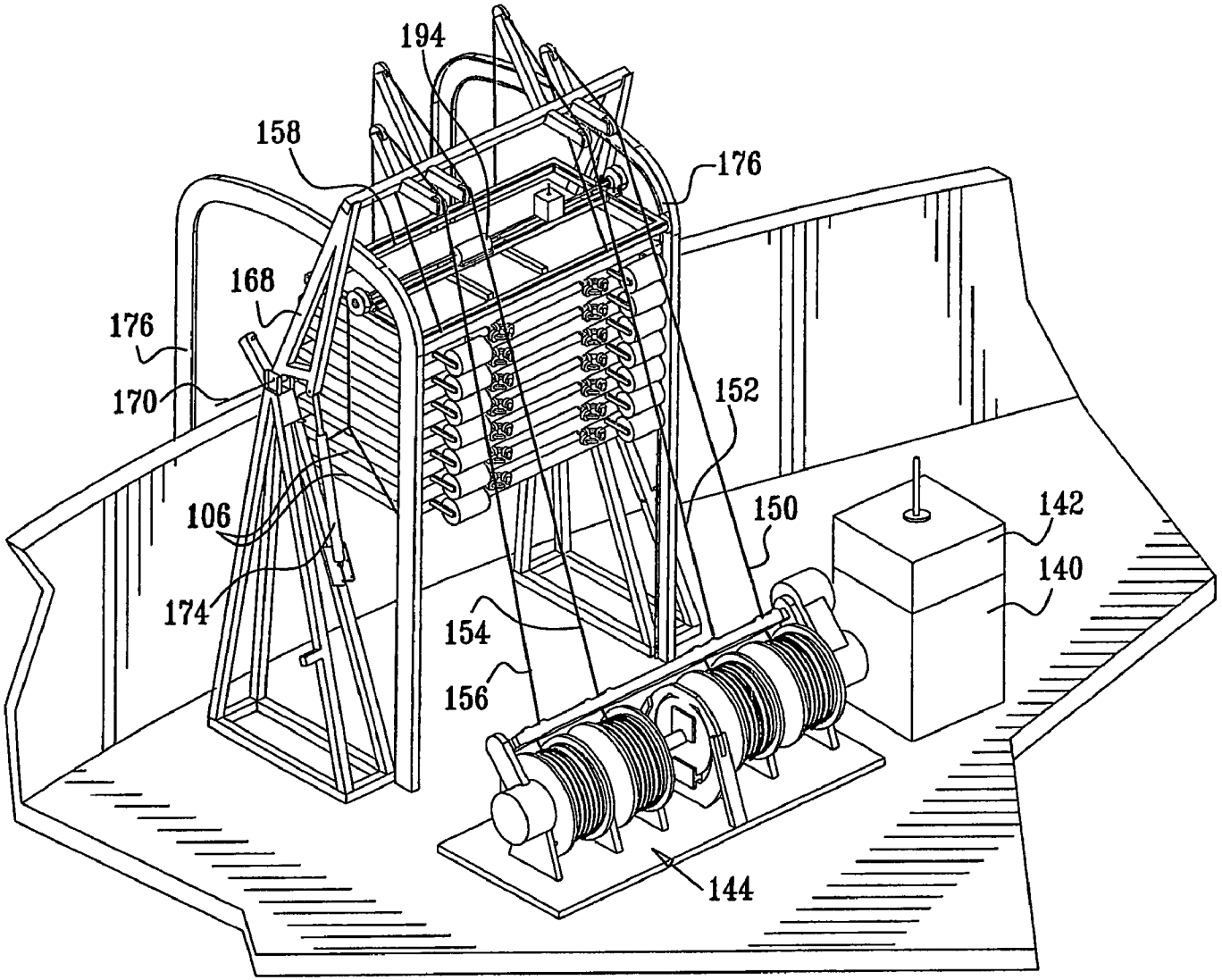

Reference is now made to FIG. 2B, which illustrates the mechanism of FIG. 2A following raising of the transporter top frame 158 and stacked platforms 106 by action of winch/brake assembly 144, and following partial rotation of deployment frame 168 about axis 170 produced by action of pistons 174.

Figure 2C:
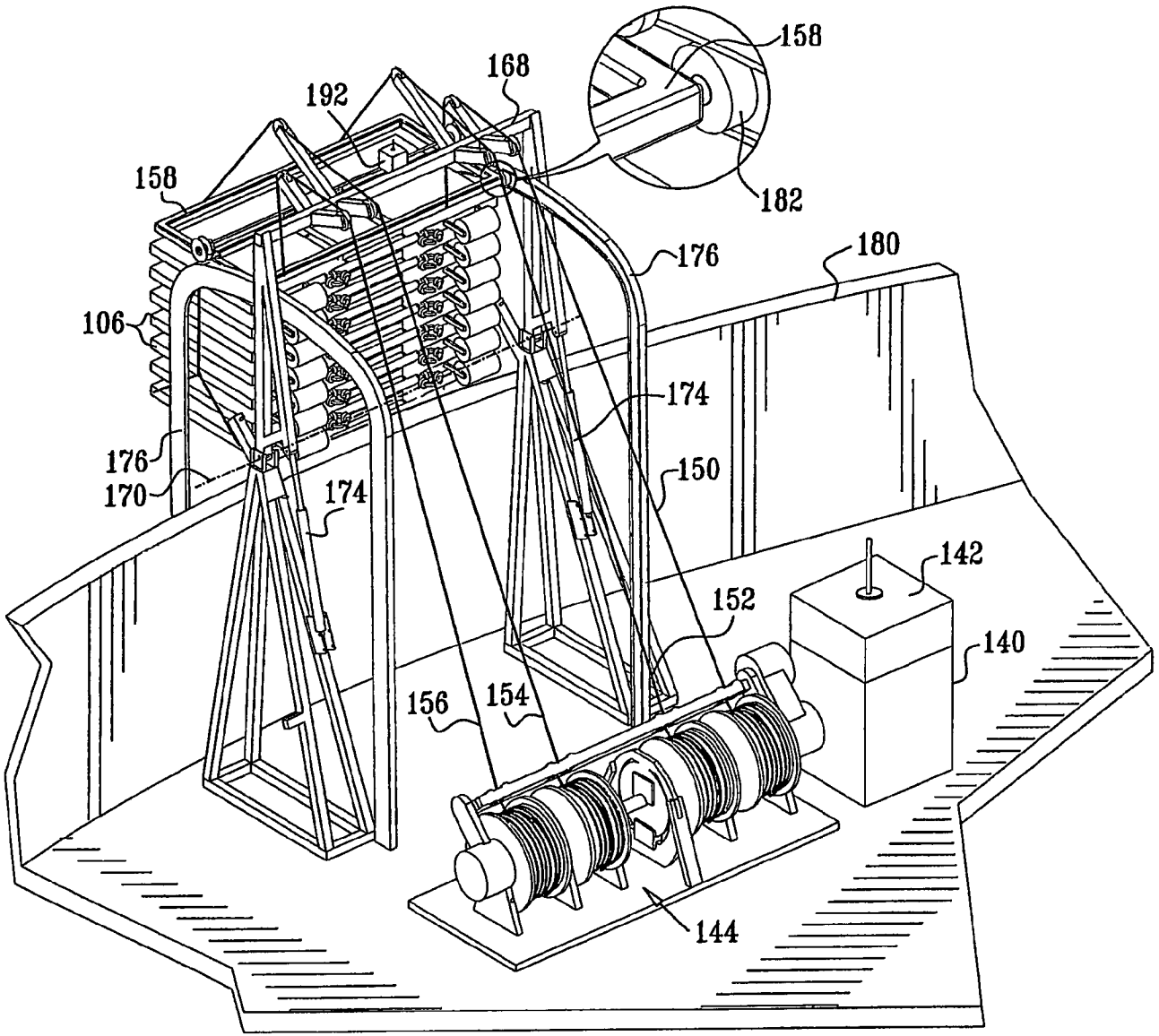

FIG. 2C illustrates the mechanism of FIG. 2B following lateral displacement of transporter top frame 158 and stacked platforms 106 along tracks 176 provided by further rotation of deployment frame 168 about axis 170 produced by action of pistons 174. It is seen that cables 150, 152, 154 and 156 are played out somewhat by winch/brake assembly 144 to accommodate this lateral displacement.

Figure 2D:
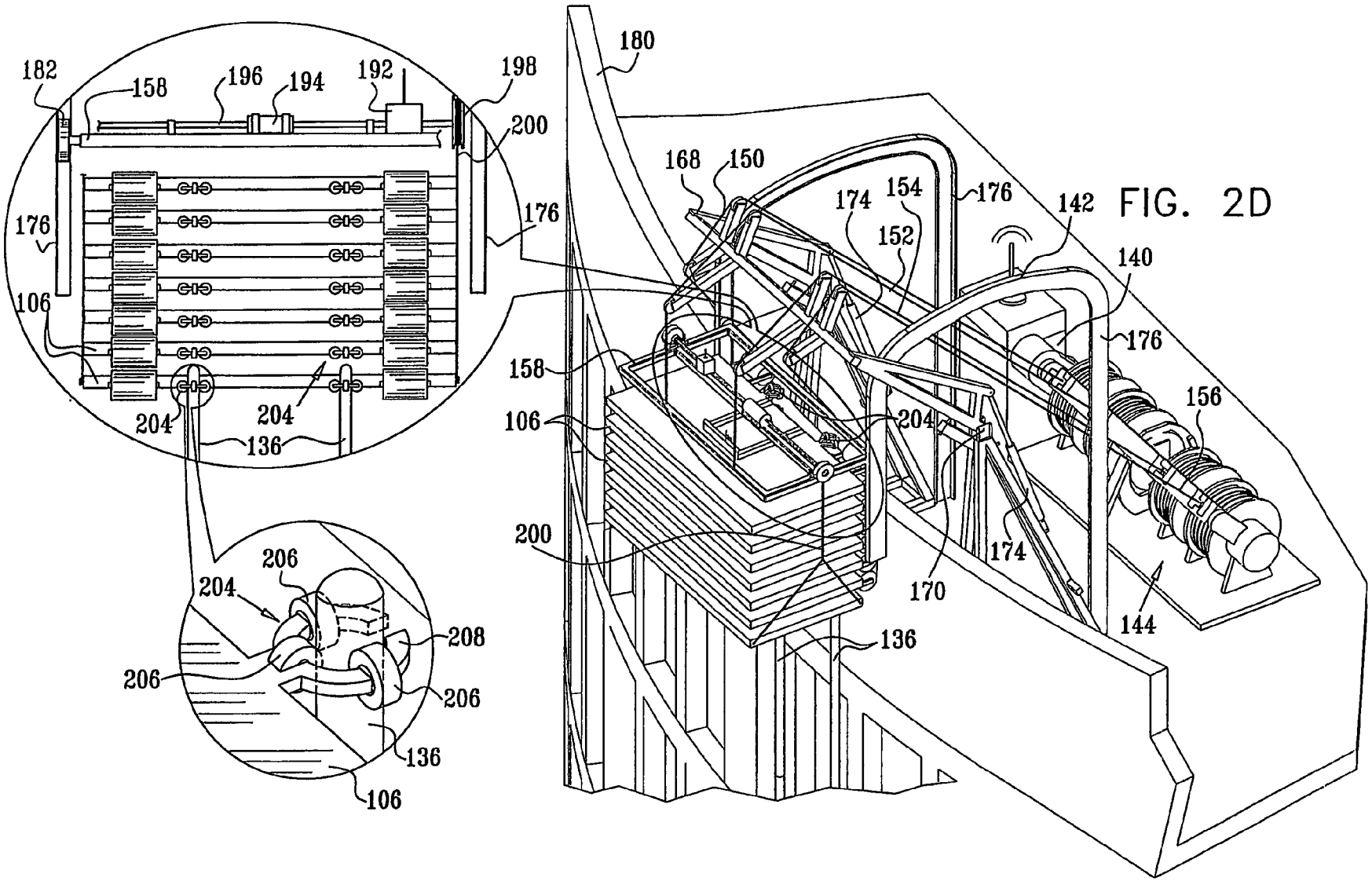

Reference is now made to FIG. 2D, which illustrates the mechanism of FIG. 2C following further lateral and downwardly vertical displacement of transporter top frame 158 and stacked platforms 106 along tracks 176 provided by additional rotation of deployment frame 168 about axis 170 produced by maximum extension of pistons 174. FIG. 2D additionally illustrates initial engagement of building mounted guide riding roller assemblies 204 with vertical guides 136, resulting inter alia from lowering of platforms 106 together with transporter top frame 158 produced by playing out of cables 150, 152, 154 and 156 by winch/brake assembly 144. It is seen that assemblies 204 preferably include at least three rollers 206 mounted on a generally peripheral support 208.

Figure 2E:
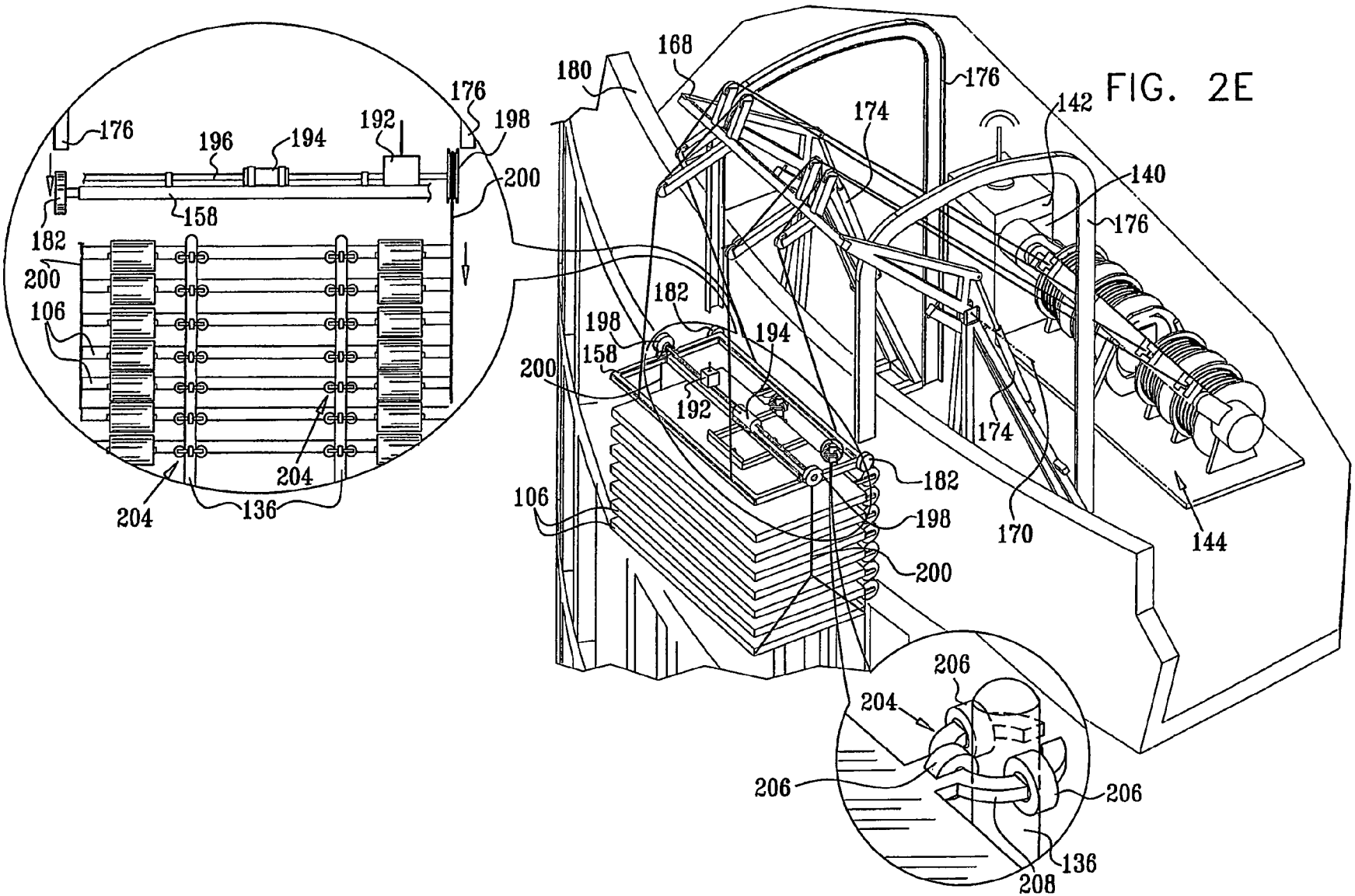

Reference is now made to FIG. 2E, which illustrates the mechanism of FIG. 2D following further downwardly vertical displacement of transporter top frame 158 and stacked platforms 106 along tracks 176 provided by action of winch/brake assembly 144, resulting in disengagement of rollers 182 of transporter top frame 158 from tracks 176. FIG. 2E additionally illustrates engagement of all building mounted guide riding roller assemblies 204 with vertical guides 136, followed by lowering of platforms 106 relative to transporter top frame 158 produced by unwinding of cables 200 from pulleys 198 by action of motor/brake assembly 194.

Figure 2F:
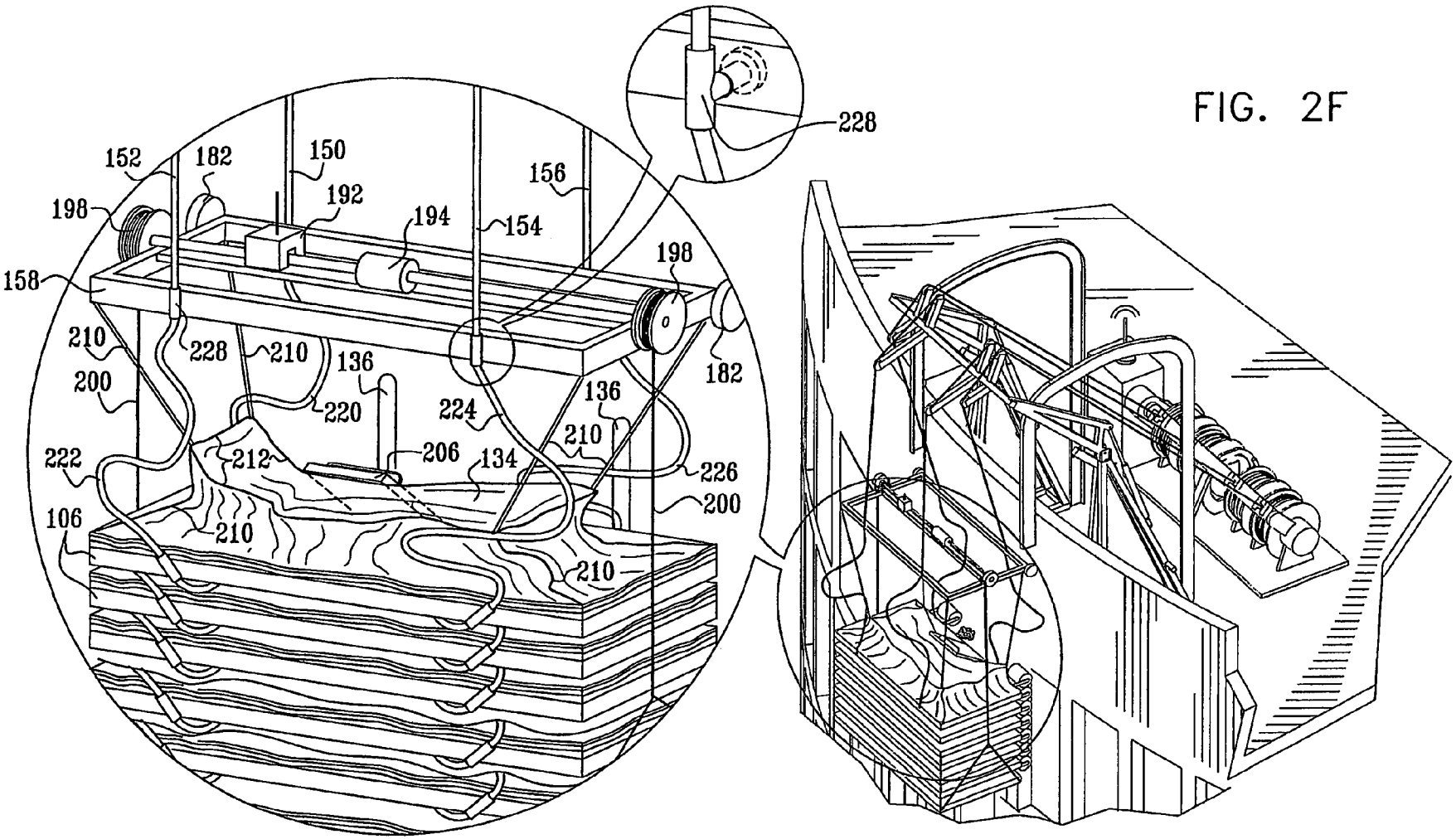

Reference is now made to FIG. 2F, which illustrates the mechanism of FIG. 2E following further lowering of platforms 106 relative to transporter top frame 158 produced by further unwinding of cables 200 from pulleys 198 by action of motor/brake assembly 194. It is seen that peripheral enclosing element 134 is beginning to be unfolded, being pulled upward by a plurality of tensioning lines 210 which are connected to transporter top frame 158. Tensioning lines 210 preferably are attached to elastic bands 212 provided along a top portion of peripheral enclosing element 134. Tensioning lines 210 preferably also extend beyond elastic bands 212 and are attached to platform 106.

It is also seen that extensions 220, 222, 224 and 226 of respective cables 150, 152, 154 and 156 interconnect the transporter top frame 158 with the platform 106 lying therebelow and similar extensions interconnect the individual stacked platforms 106 with each other and support their weight and the weight of loads applied thereto. When the platforms 106 are in a stacked orientation as shown in FIGS. 2A-2E, the extensions lie therebetween and are not tensioned, however, when the platforms 106 are fully deployed at their intended spaced mutual orientations, the cable extensions are tensioned and define the spacing between vertically adjacent platforms 106.

In a preferred embodiment of the present invention, as illustrated particularly in FIG. 2F, it is seen that at transporter top frame 158 and at each of platforms 106, each of cables 150, 152, 154 and 156 or its respective extension, is anchored, preferably by means of a pivotable anchor assembly 228.

Figure 2G:
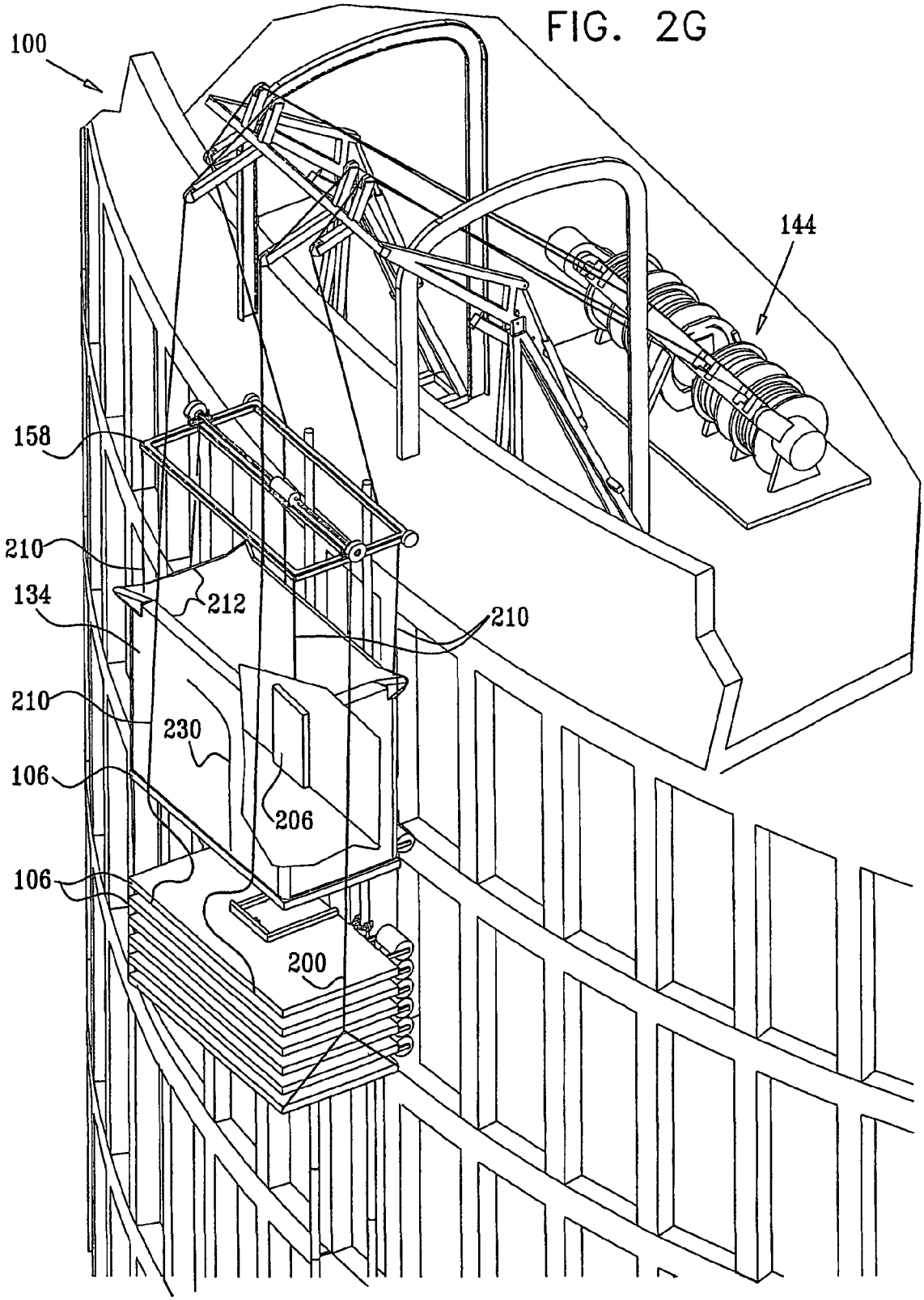

Reference is now made to FIG. 2G, which illustrates a topmost platform 106 of a transporter 100 being fully deployed and its peripheral enclosing element 134 being fully tensioned by tensioning lines 210 and elastic bands 212, with the remaining platforms 106 and peripheral enclosing elements 134 being in a stacked not-yet deployed orientation. It is seen that peripheral enclosing element 134 includes an egress opening 230, such as a zippered egress opening, and has associated therewith a selectably positionable evacuation bridge 206, preferably in an upright orientation.

Figure 2H:
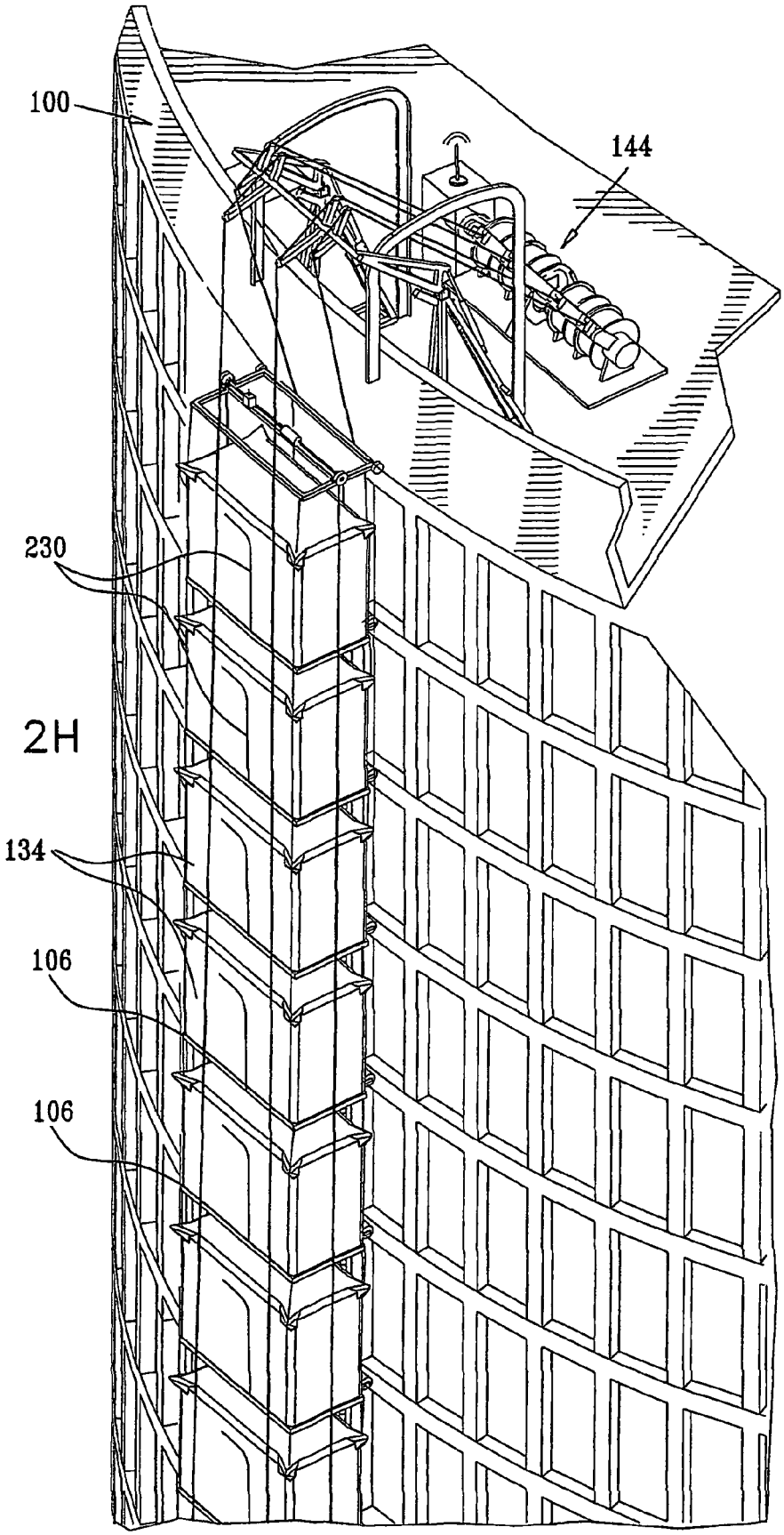
Figure 21:
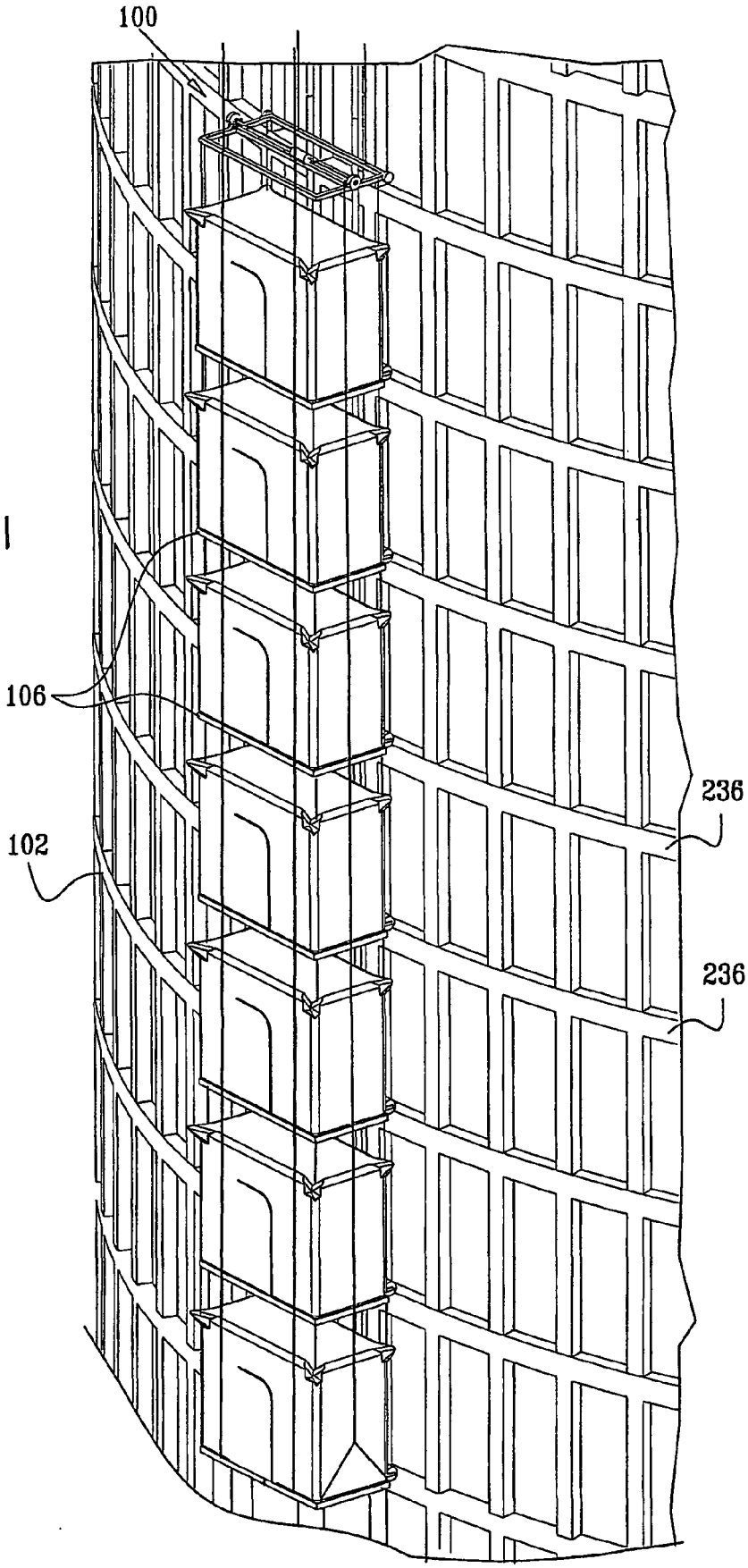

FIG. 2H illustrates transporter 100 when all of the platforms 106 have been fully deployed and peripheral enclosing elements 134 of each platform 106 are fully tensioned. Normally deployment of each platform 106 and tensioning of its peripheral enclosing element takes place sequentially from the top to the bottom of the transporter. It is seen that each peripheral enclosing element 134 includes an egress opening 230, such as a zippered egress opening, and has associated therewith a selectably positionable evacuation bridge 206, preferably in an upright orientation, as shown in FIG. 2G.

FIG. 2I shows the fully deployed transporter 100 being lowered, preferably by action of winch/brake assembly 144 into a desired vertical position relative to building 102, such that each of platforms 106 is properly aligned with a separate building floor, here designated 236.

Figure 2J:
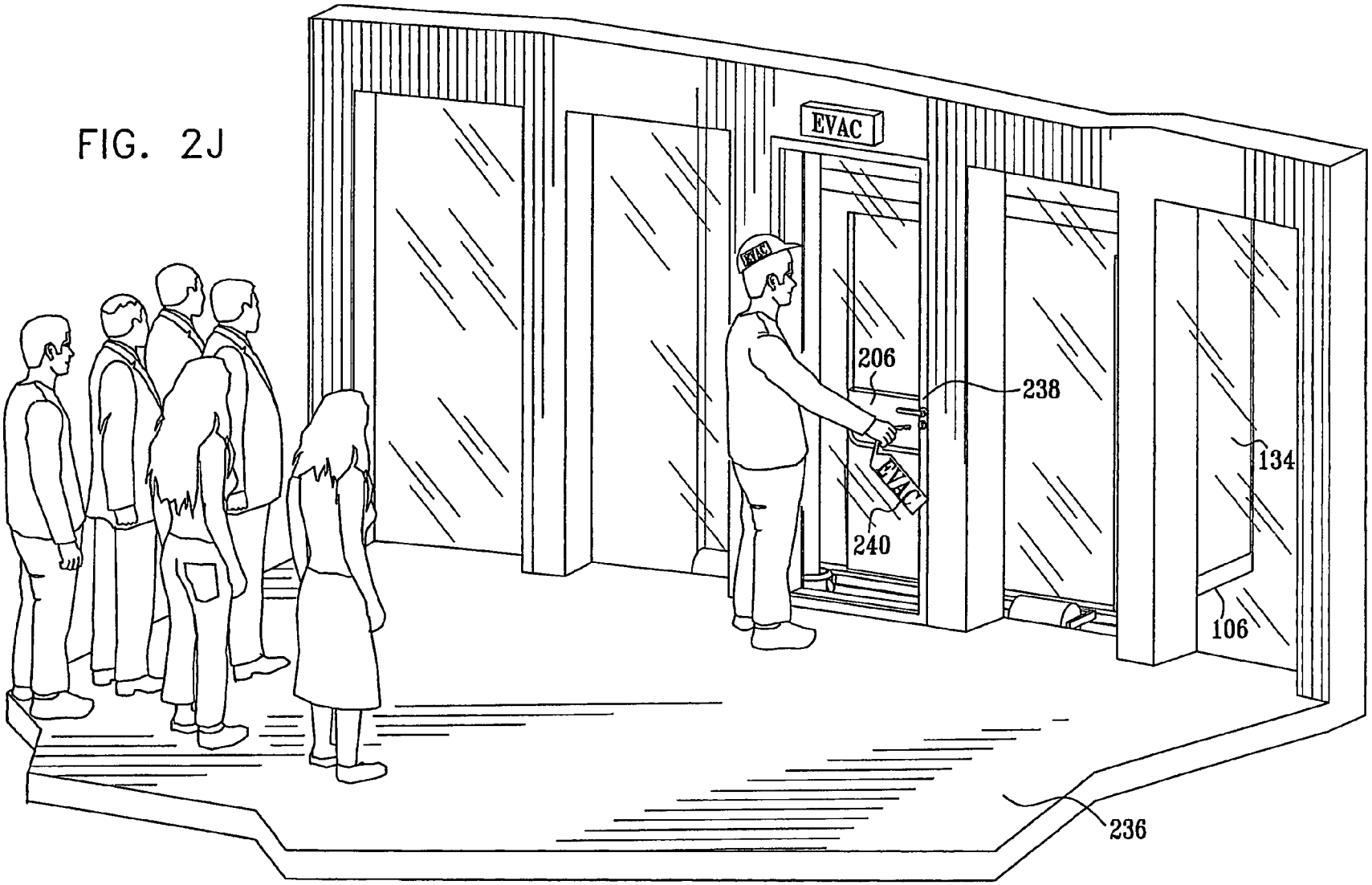
Figure 2K:
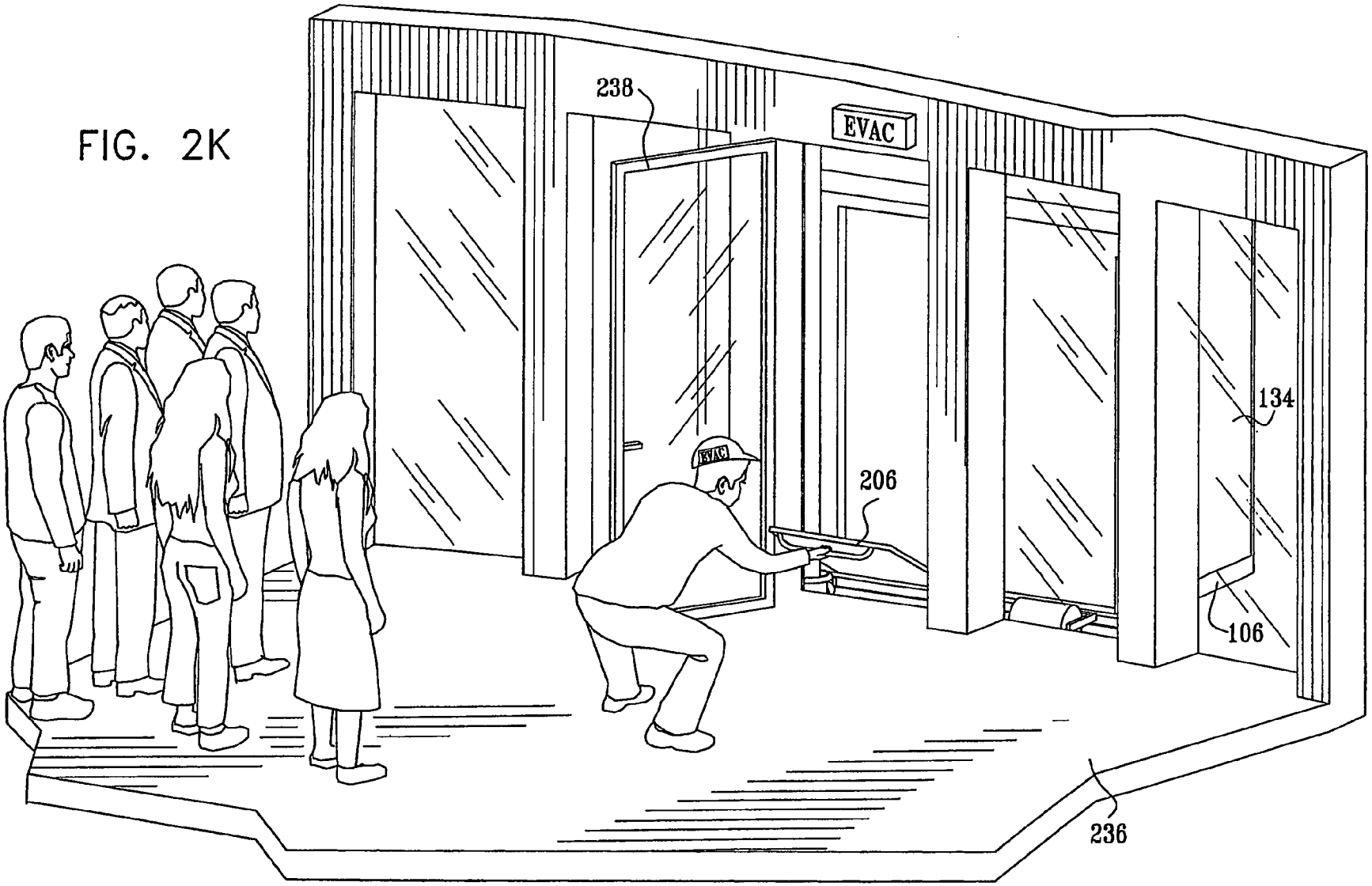
Figure 2L:
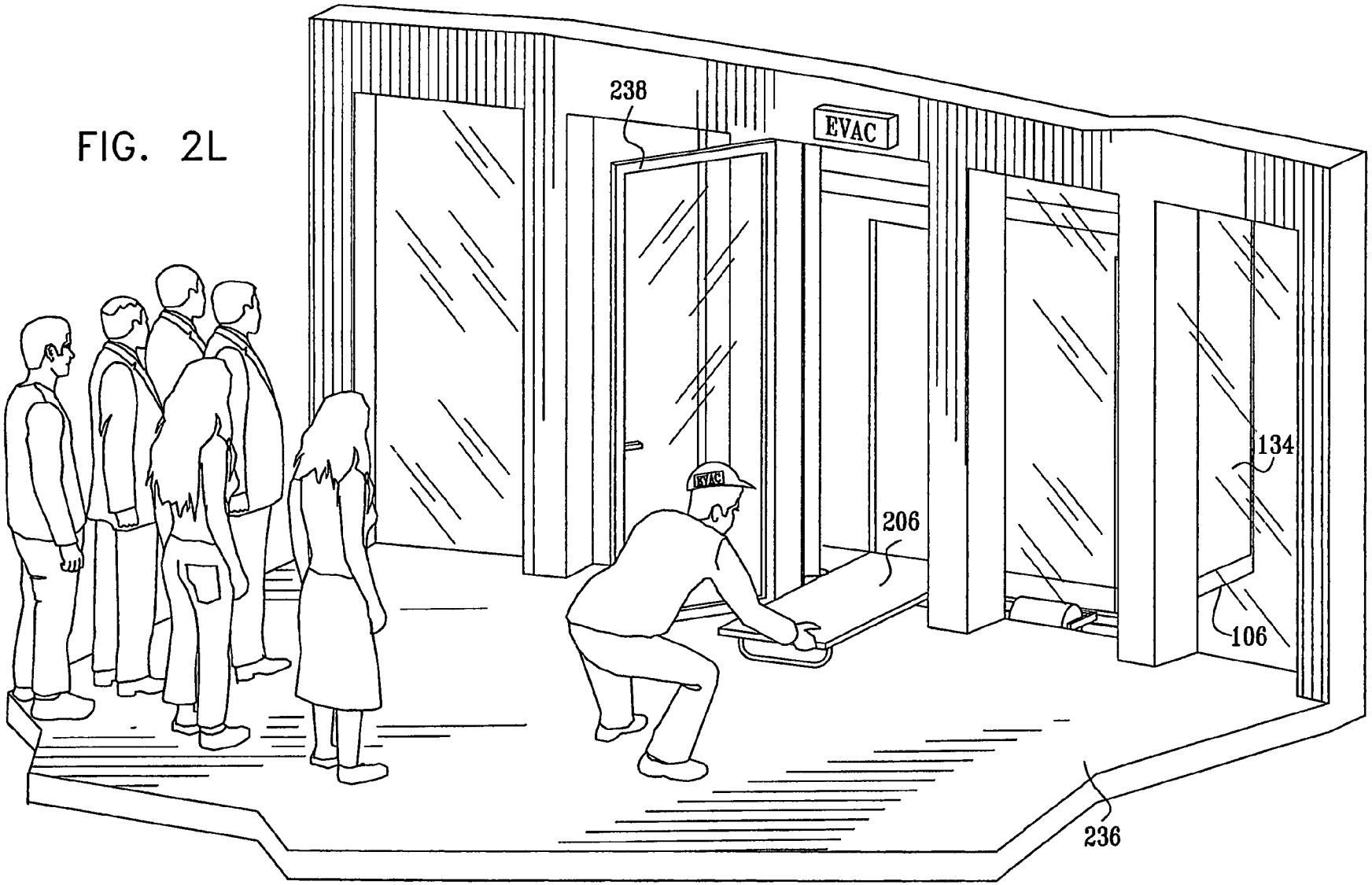
Figure 2M:
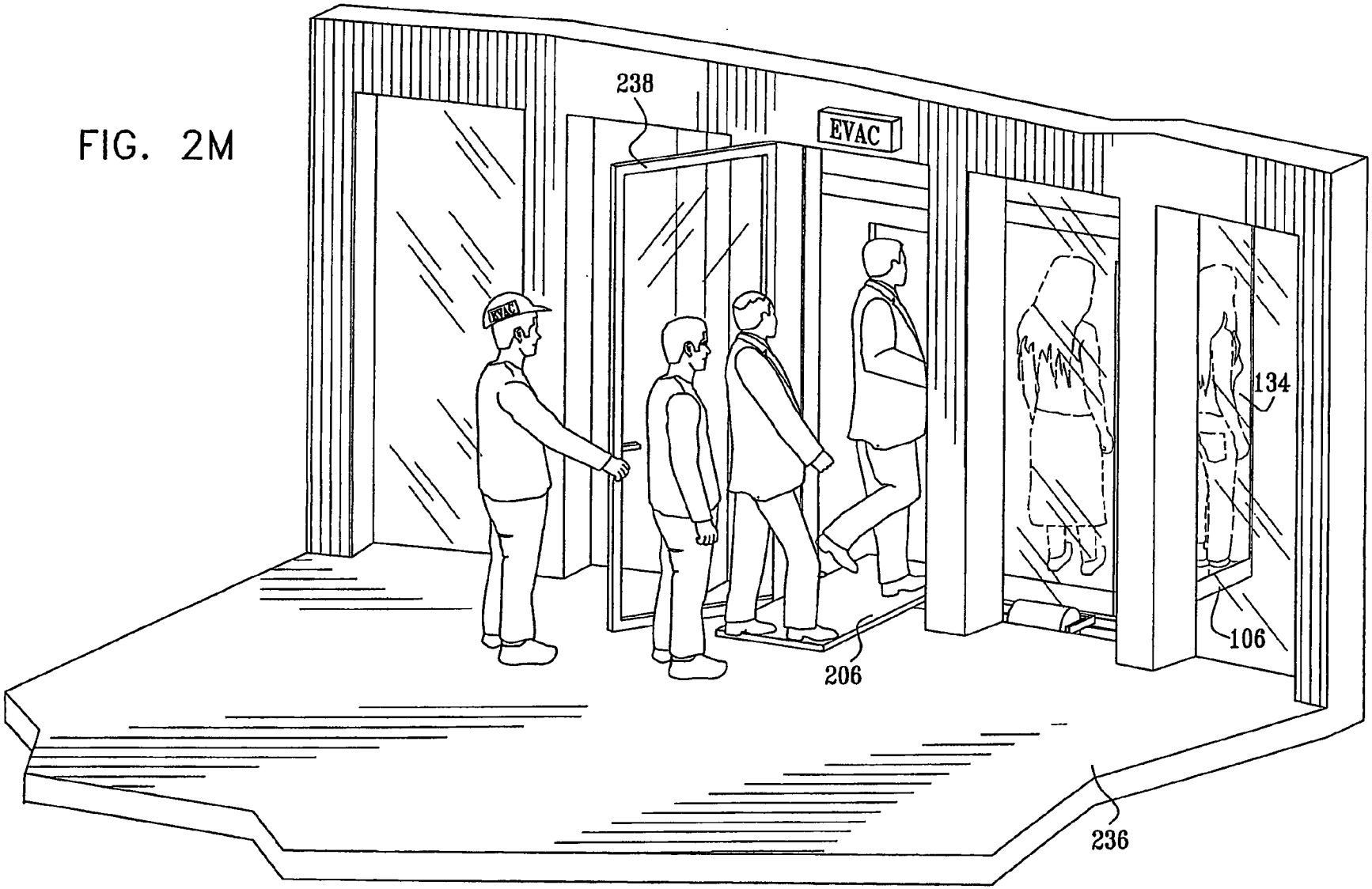

Reference is now made to FIG. 2J, which illustrates a platform 106 deployed in proper vertical alignment with a building floor 236, such that evacuation bridge 206 is positioned opposite an emergency evacuation door 238. An authorized individual, such as an evacuation team leader, typically employs an evacuation emergency key 240 to open emergency evacuation door 238. FIGS. 2K and 2L show the evacuation team leader positioning evacuation bridge 206, while FIG. 2M shows evacuation of persons from building floor 236 onto platform 106 within peripheral enclosing element 134. It is appreciated that evacuation of multiple building floors onto multiple platforms 106 of one or more transporters 100 may take place simultaneously.

Figure 2N:
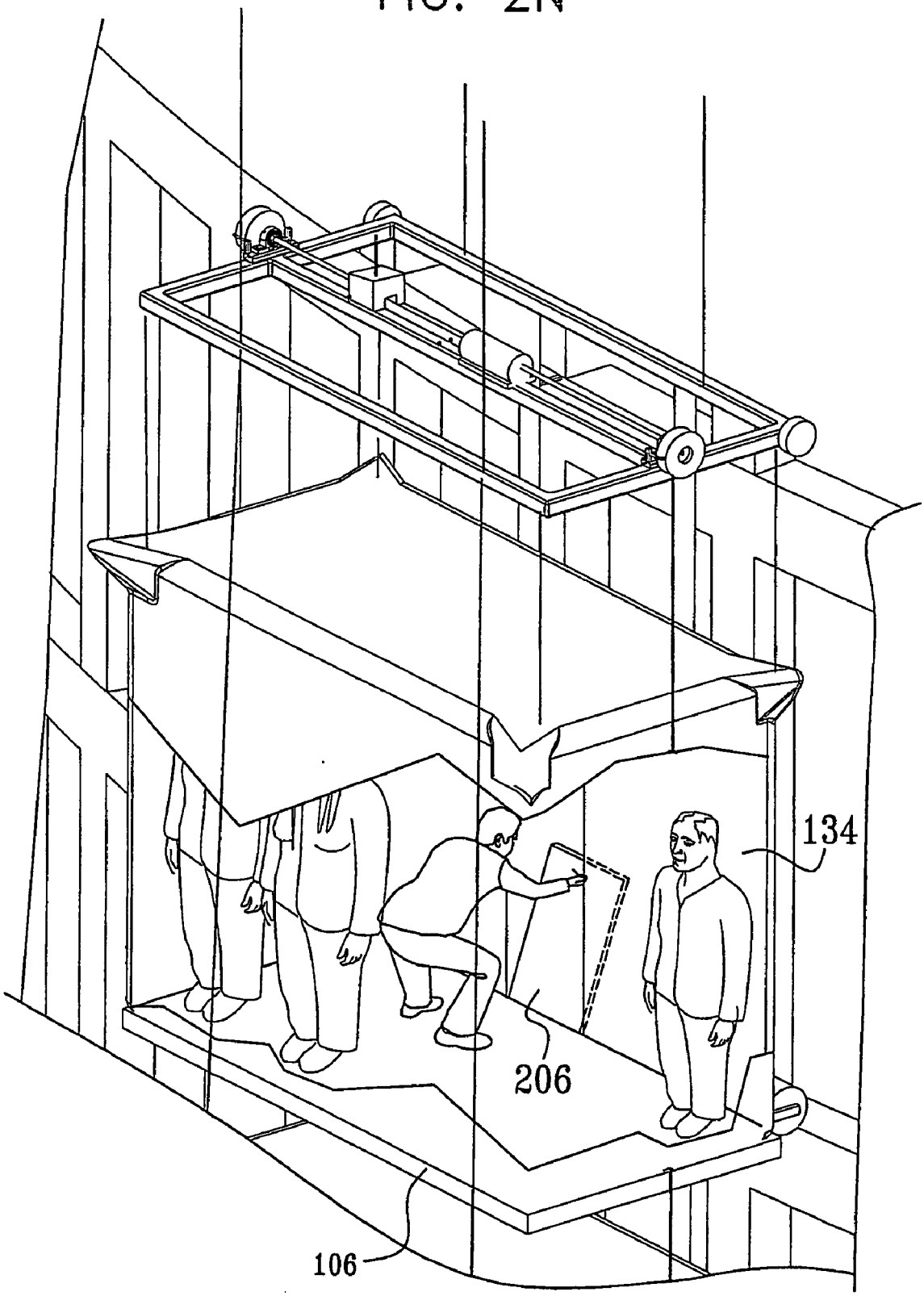
Figure 20:
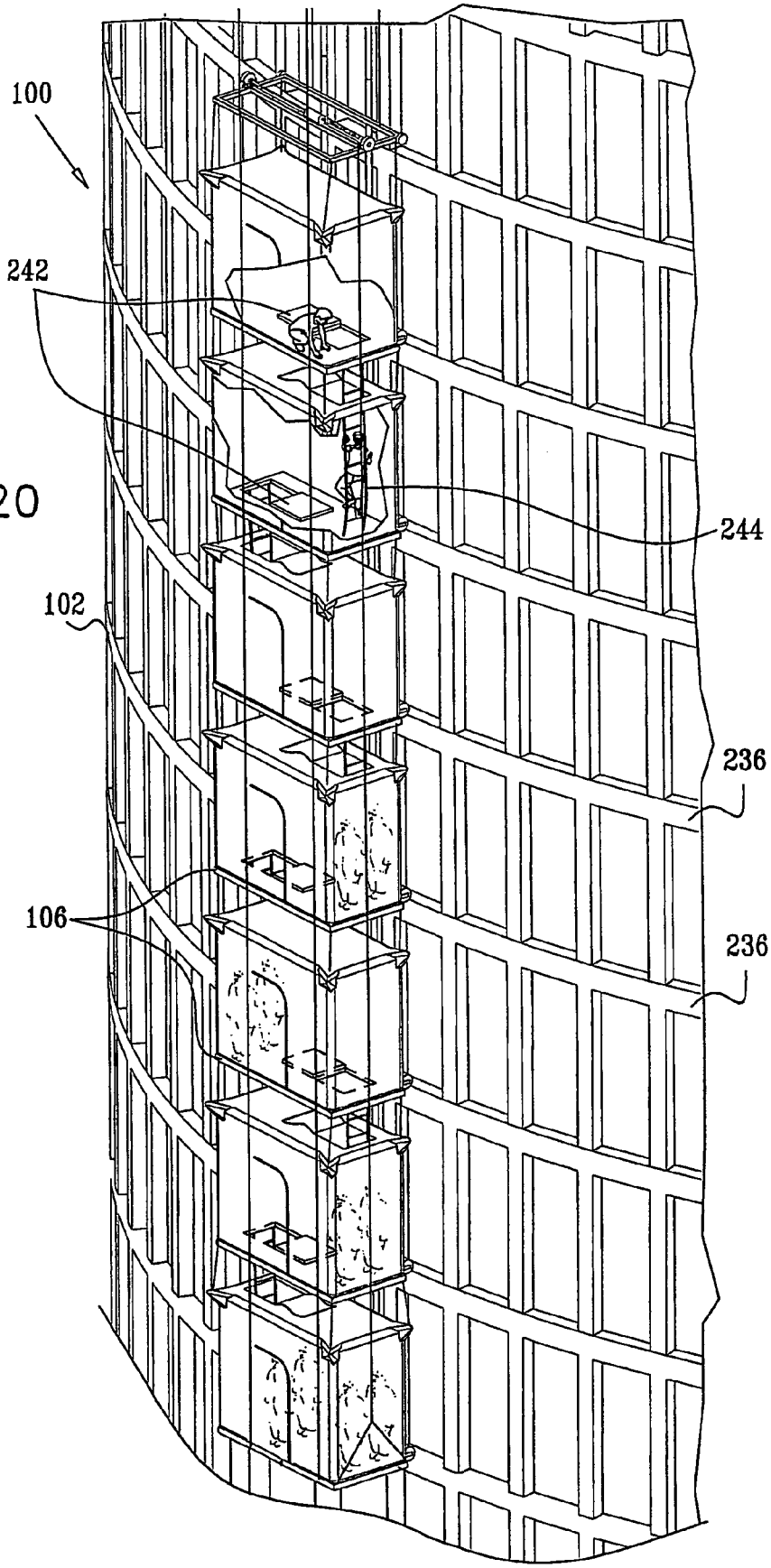

Reference is now made to FIG. 2N, which shows the evacuation team leader folding up the evacuation bridge 206 and securing it to the peripheral enclosing element 134 to serve as a security gate. FIG. 2O illustrates an optional structure wherein passageways, typically including trap doors 242 and ladders 244, enable people to move between platforms 106 in a transporter 100.

Figure 2P:
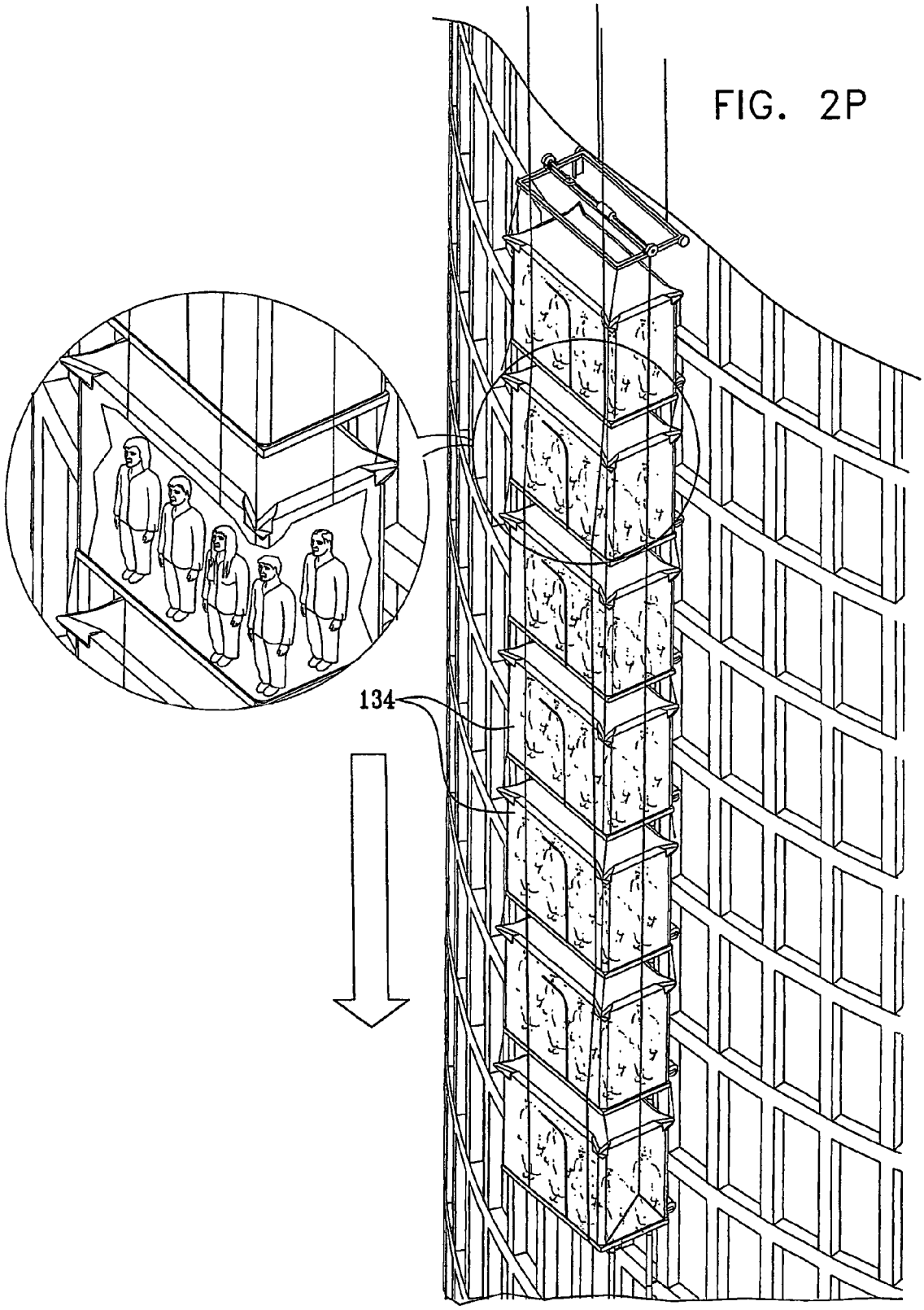

FIG. 2P illustrates lowering of a loaded transporter from its loading position toward an egress location.

Figure 2Q:
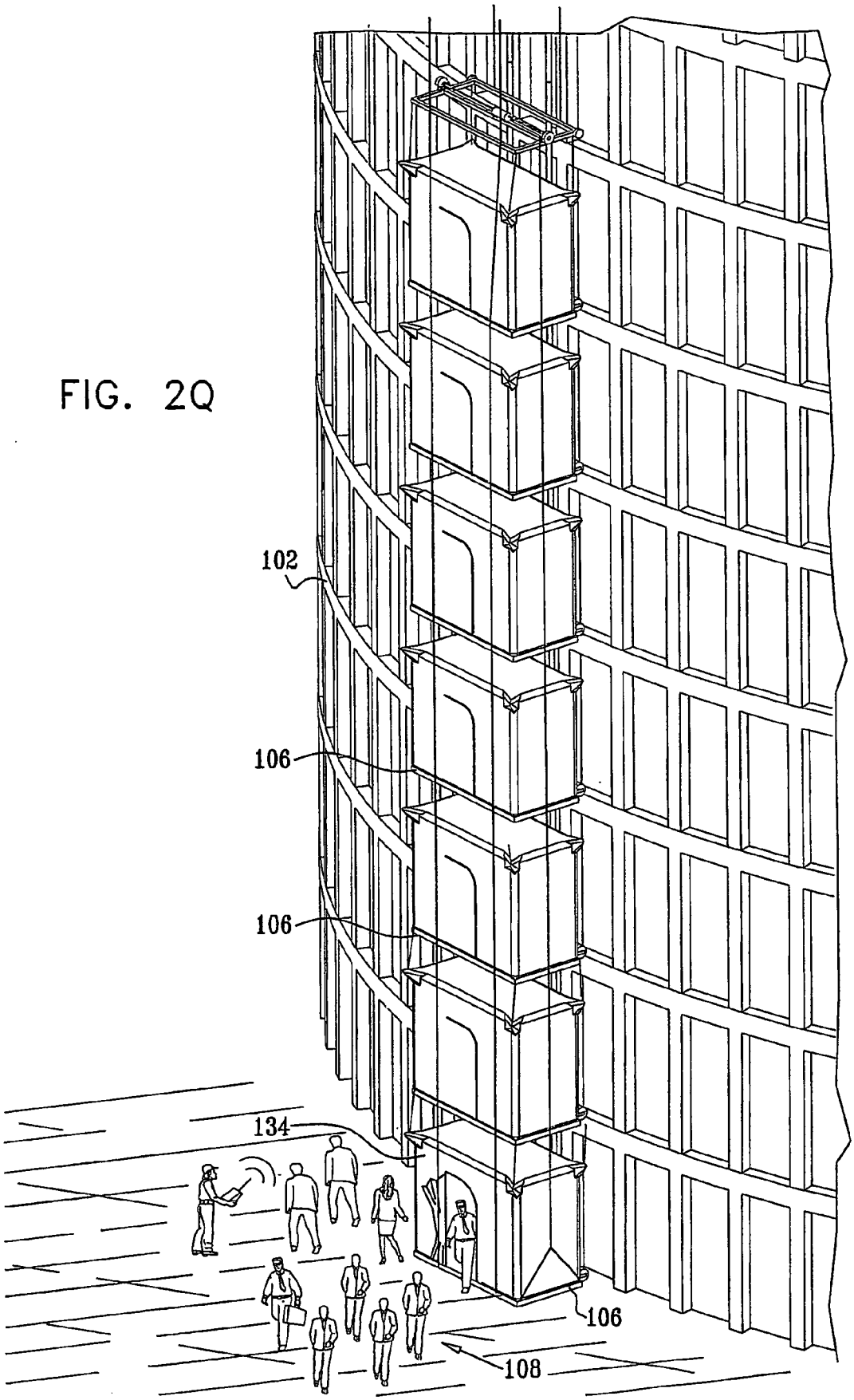
Figure 2R:
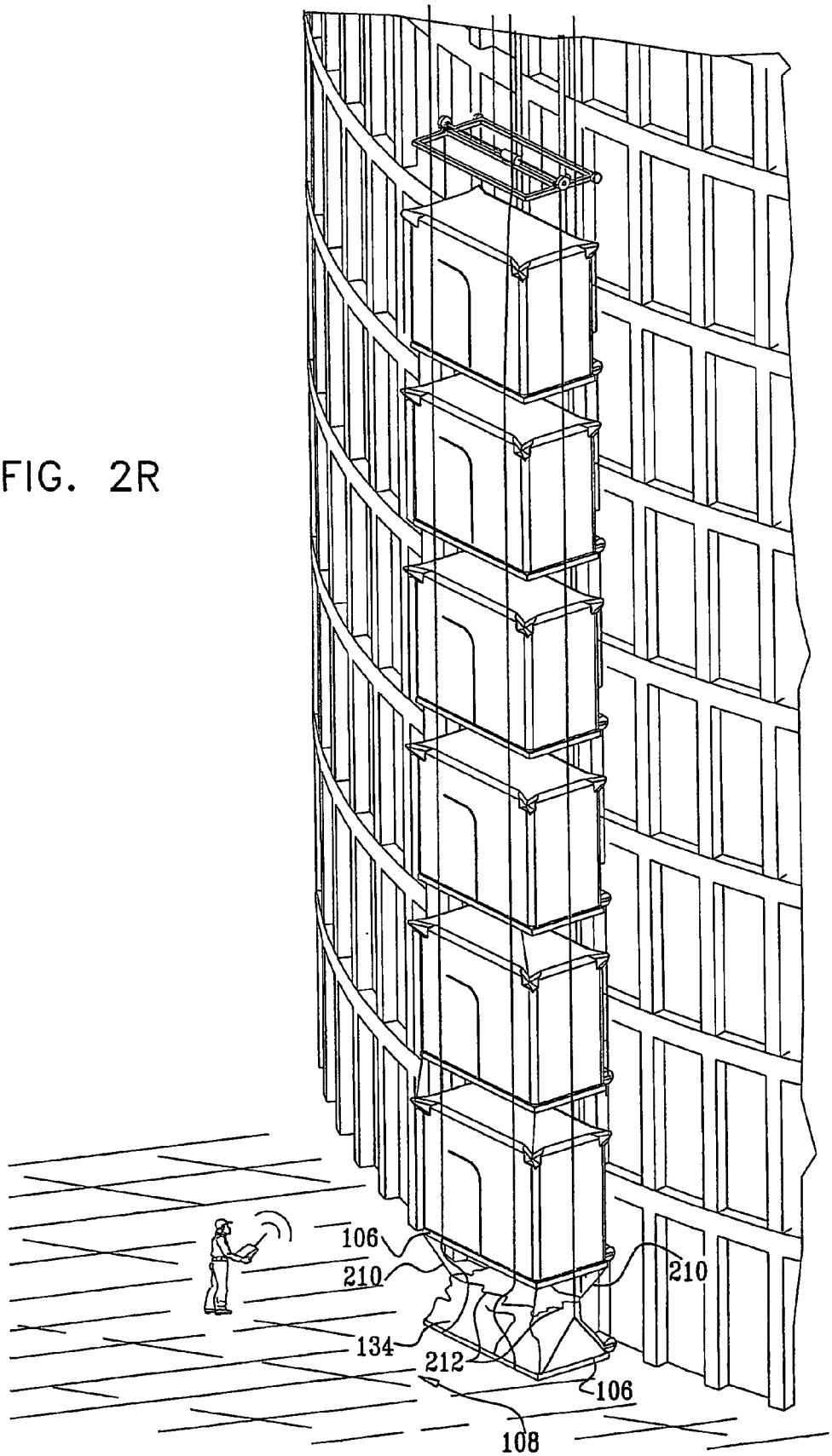
Figure 2S:
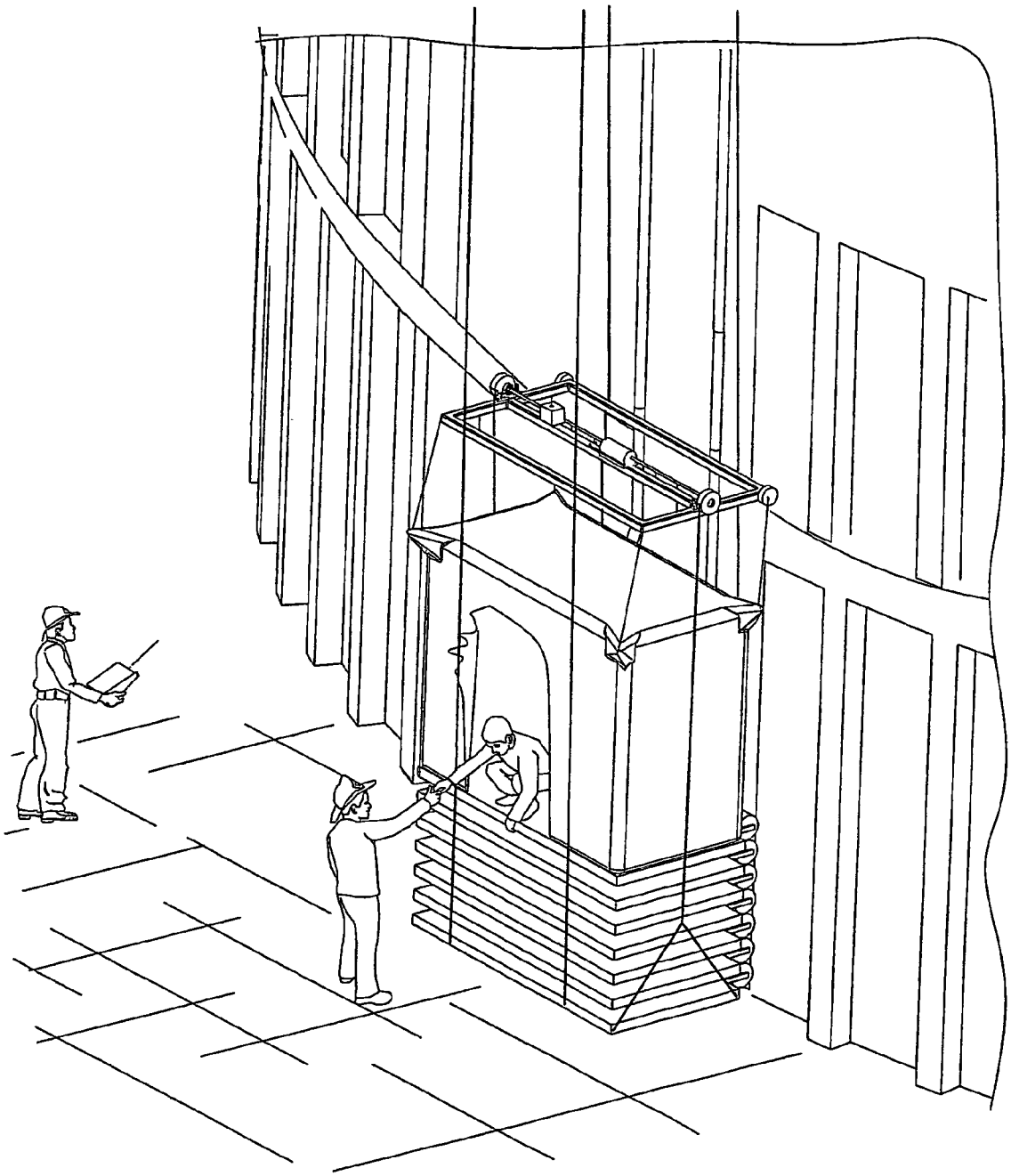

Reference is now made to FIG. 2Q, which illustrates egress of evacuees from a lowest platform 106 of a transporter at egress level 108, and to FIG. 2R, which illustrates the next lowest platform 106 being lowered to the egress level 108 causing an easing of the tension in extensions 220, 222, 224 and 226 (FIG. 2F). As seen in FIG. 2R, peripheral enclosing element 134 surrounding the lowest platform 106 is collapsed by easing the tension on tensioning lines 210, causing elastic bands 212 to pull peripheral enclosing element 134 inward. The provision of elastic bands 212 provides for an orderly collapsing of peripheral enclosing element 134. FIG. 2S shows egress of evacuees from the highest platform.

Figure 2T:
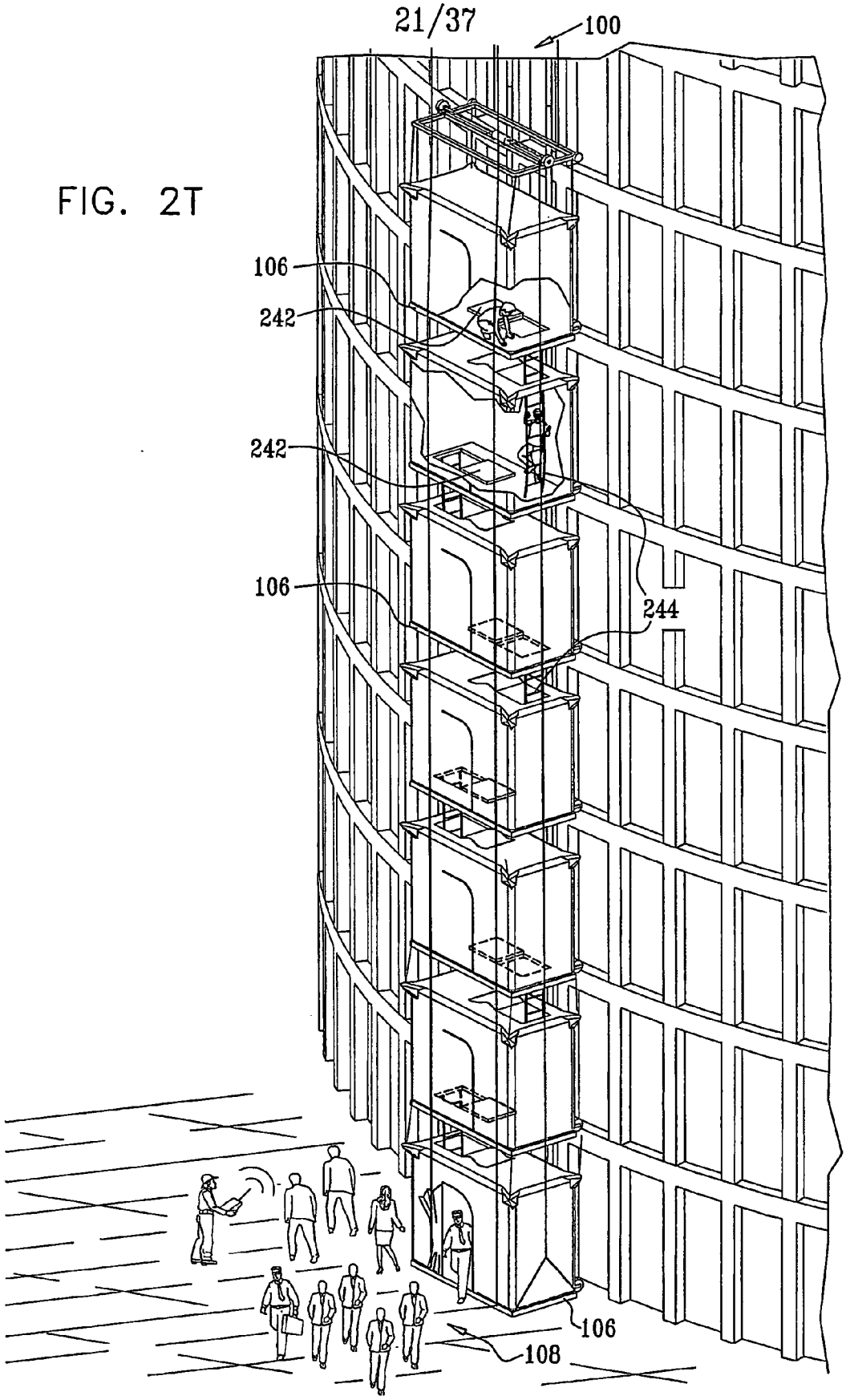

FIG. 2T shows an alternative to the functionality shown in FIG. 2Q-2S, wherein evacuees use trap doors 242 and ladders 244 to egress from the higher platforms 106 via the lowest platform 106 on the egress level 108 and the platforms 106 need not be collapsed at the time of egress. It is appreciated that simultaneous egress from multiple platforms 106 may be provided by alternative means, such as inflatable slides or any other suitable means.

Figure 2U:
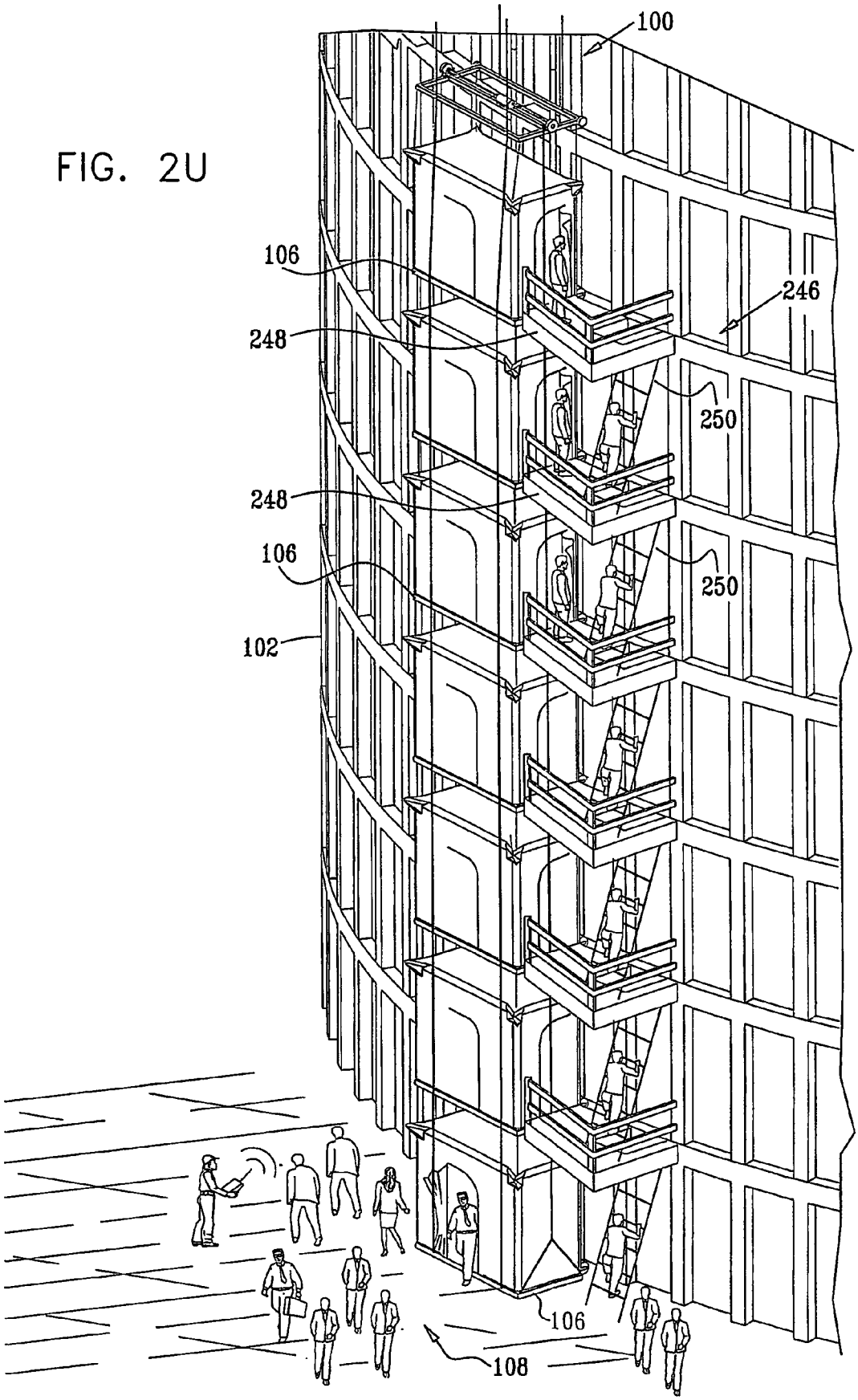

FIG. 2U illustrates another alternative to the functionality shown in FIGS. 2Q-2S. Here egress level 108 is embodied in a multi-story escape structure 246 including multiple landings 248 and stairs 250. In this embodiment, people on each of the platforms 106 may exit simultaneously onto landings 248 which lie alongside each of the platforms 106, when the transporter 100 is suitable lowered. Alternatively, the landings 248 and stairs 250 may be internal to the building 102. It is appreciated that the multi-story escape structure 246 may be a portable structure, similar to that described hereinbelow with reference to FIG. 5A-5B.

Figure 2V:
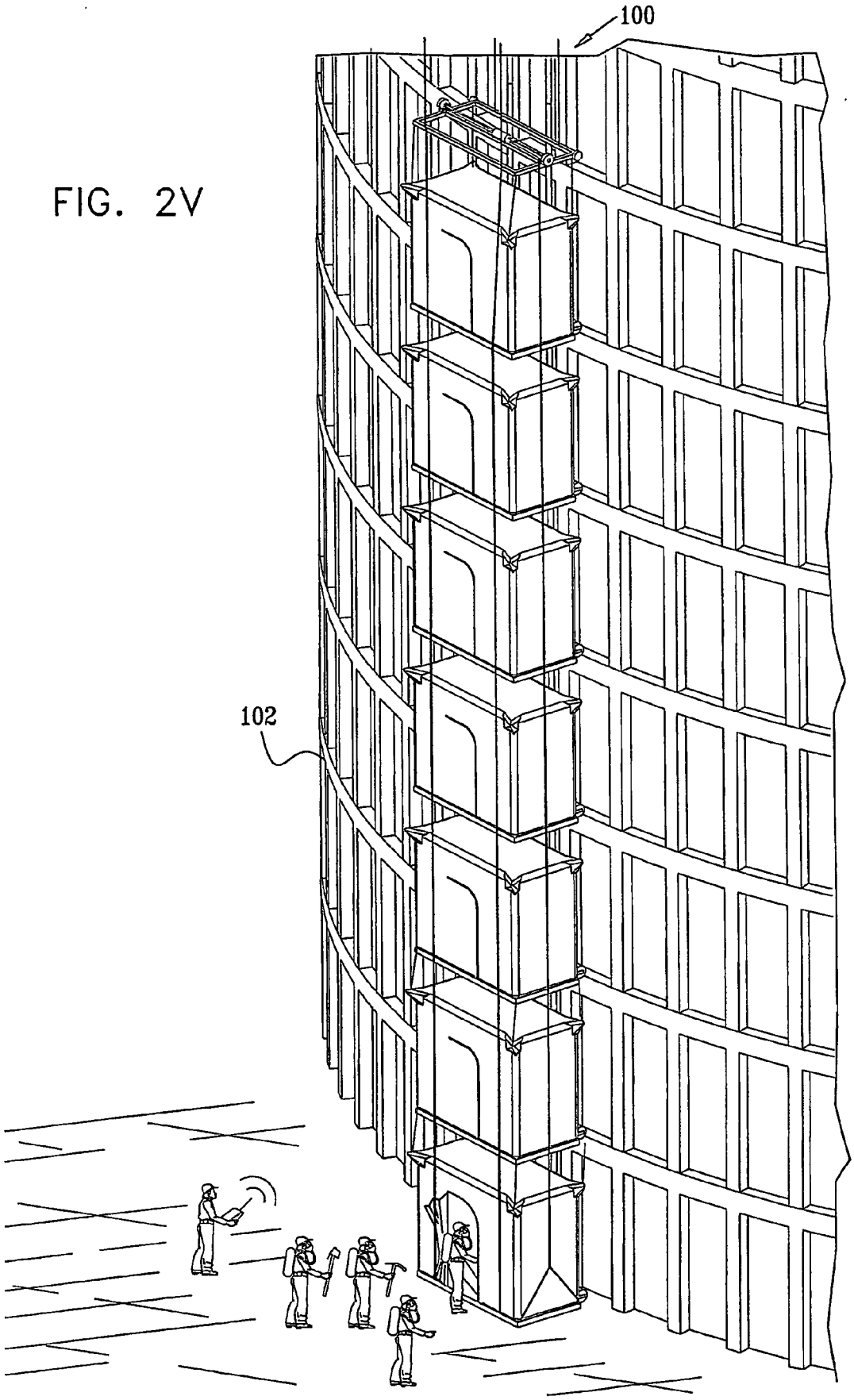
Figure 2W:
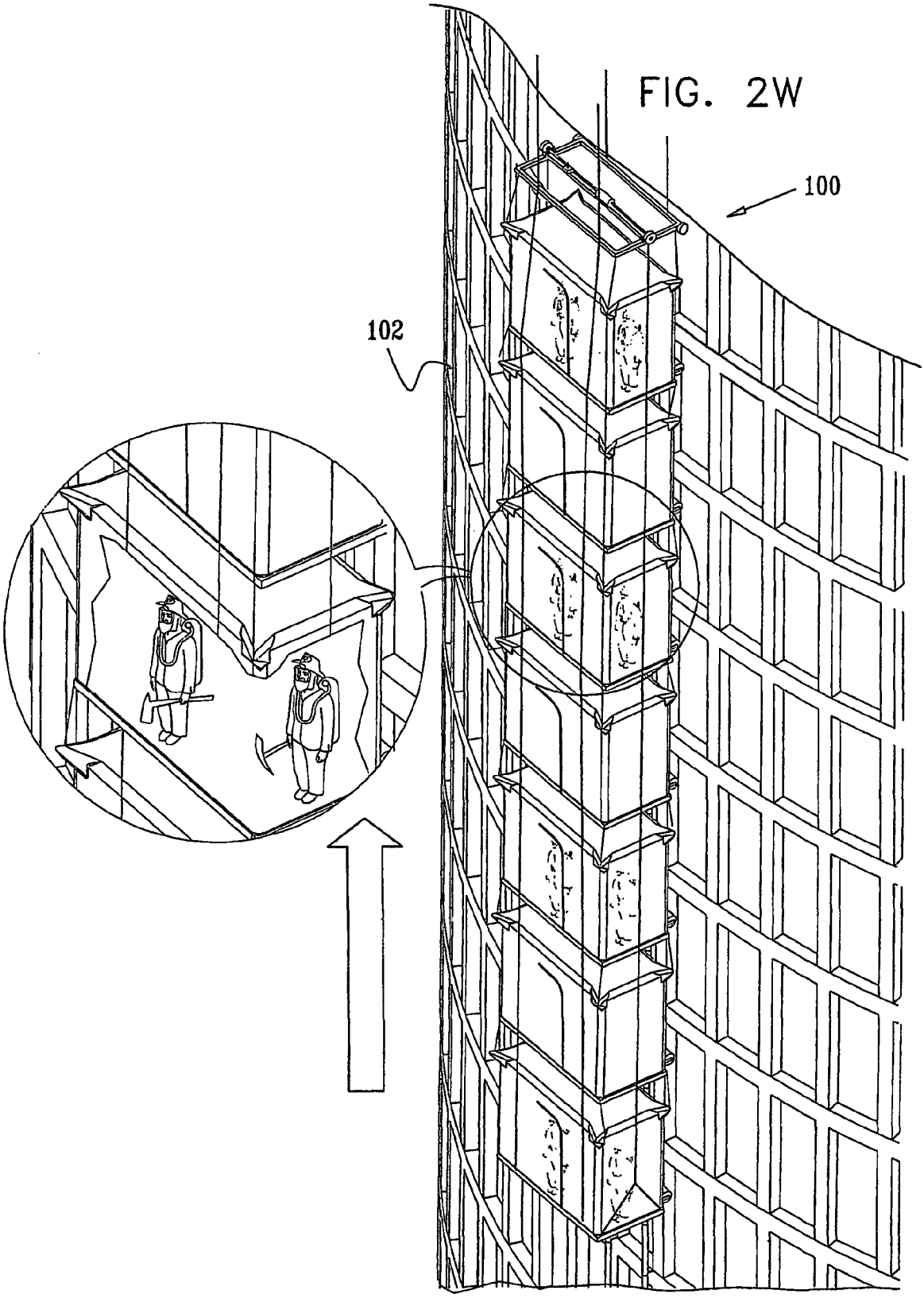

It is appreciated that irrespective of which egress functionality is employed, at this stage, the transporter 100 may be employed for raising rescue personnel or firefighters to selected floors of building 102, as shown in FIGS. 2V and 2W.

Figure 3A:
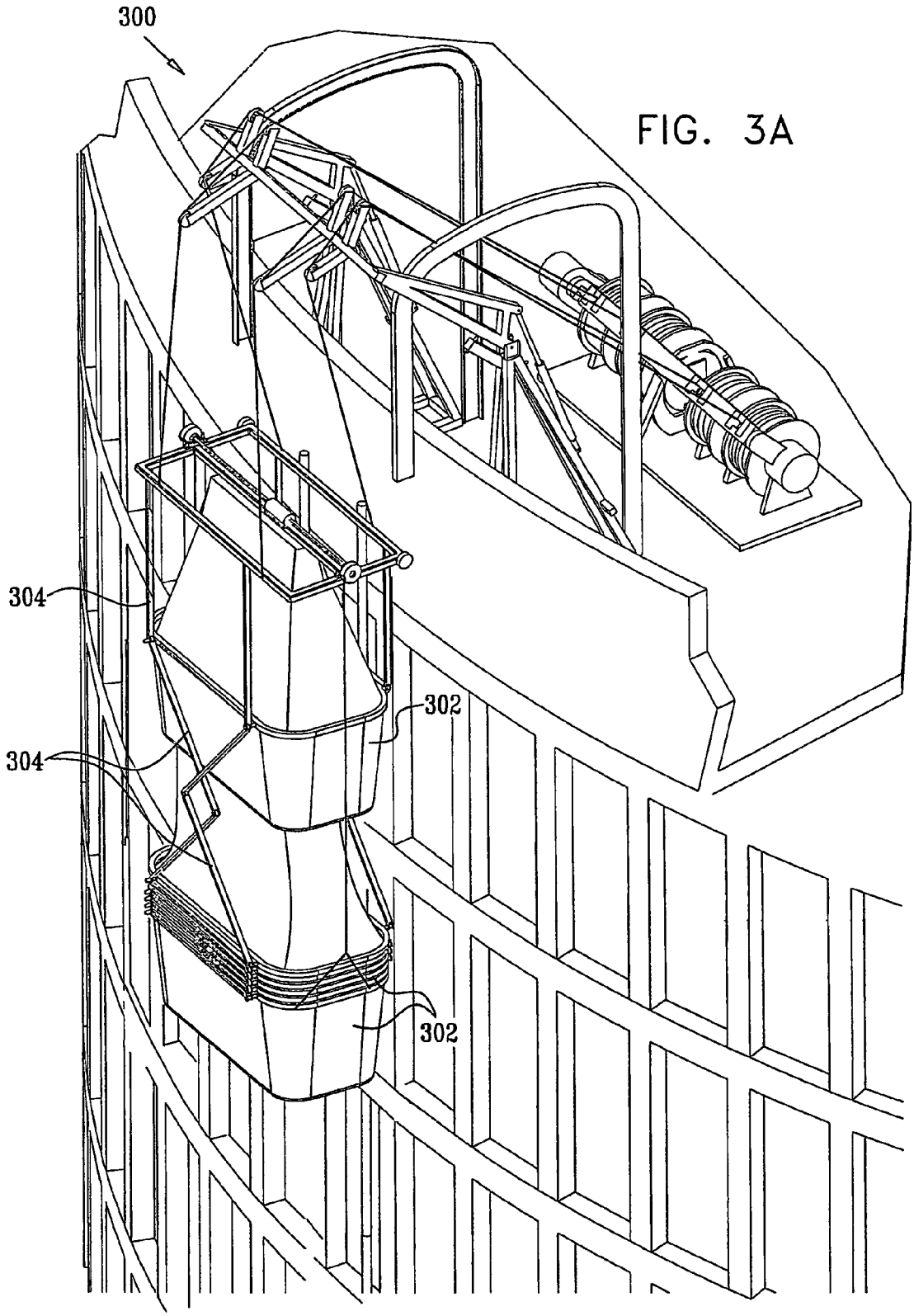
FIGS. 3A, 3B & 3C illustrate three stages in the operation of an escape transporter in a variation of the system of FIGS. 1-2W.
Figure 3B:
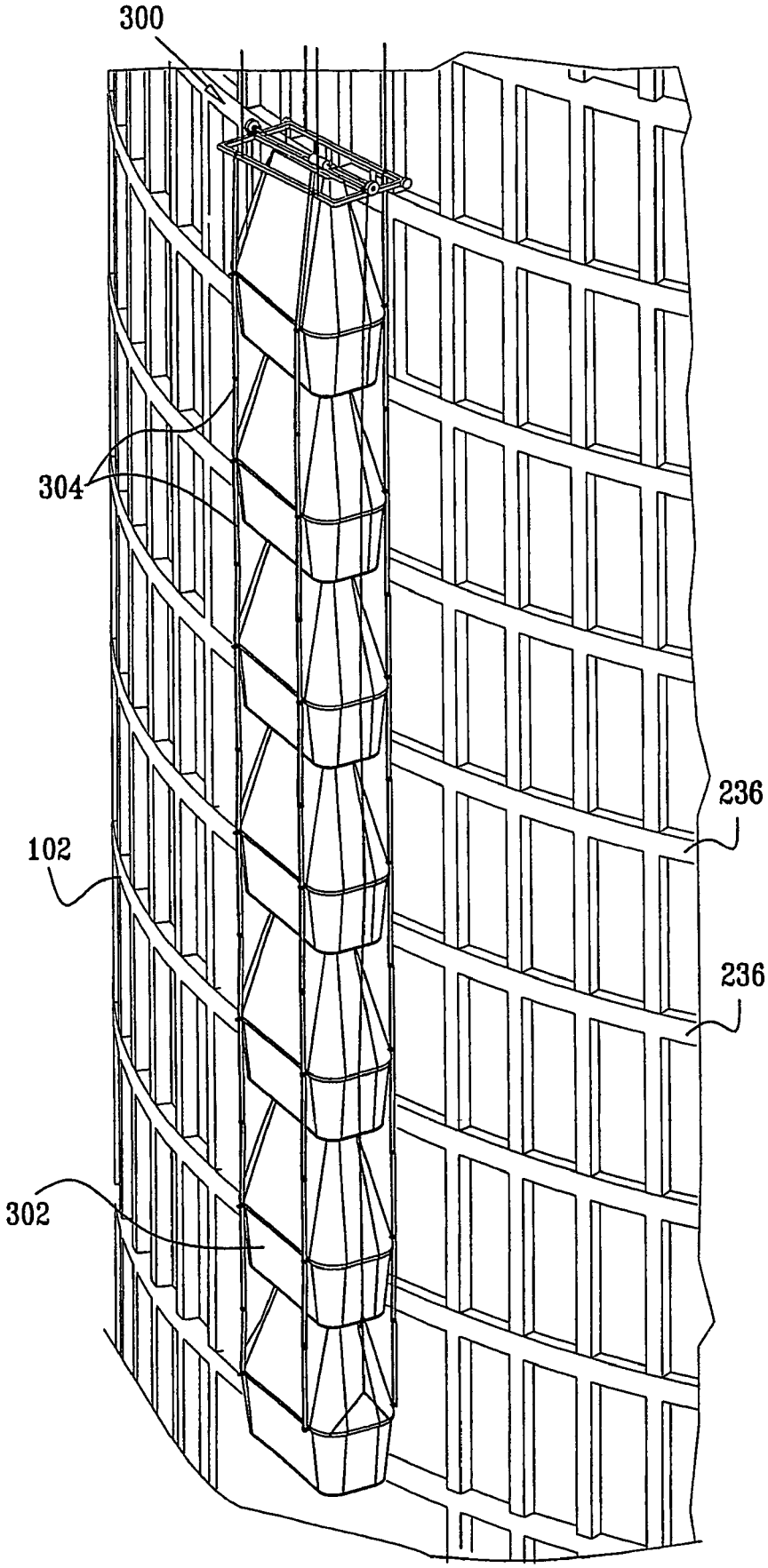
Figure 3C:
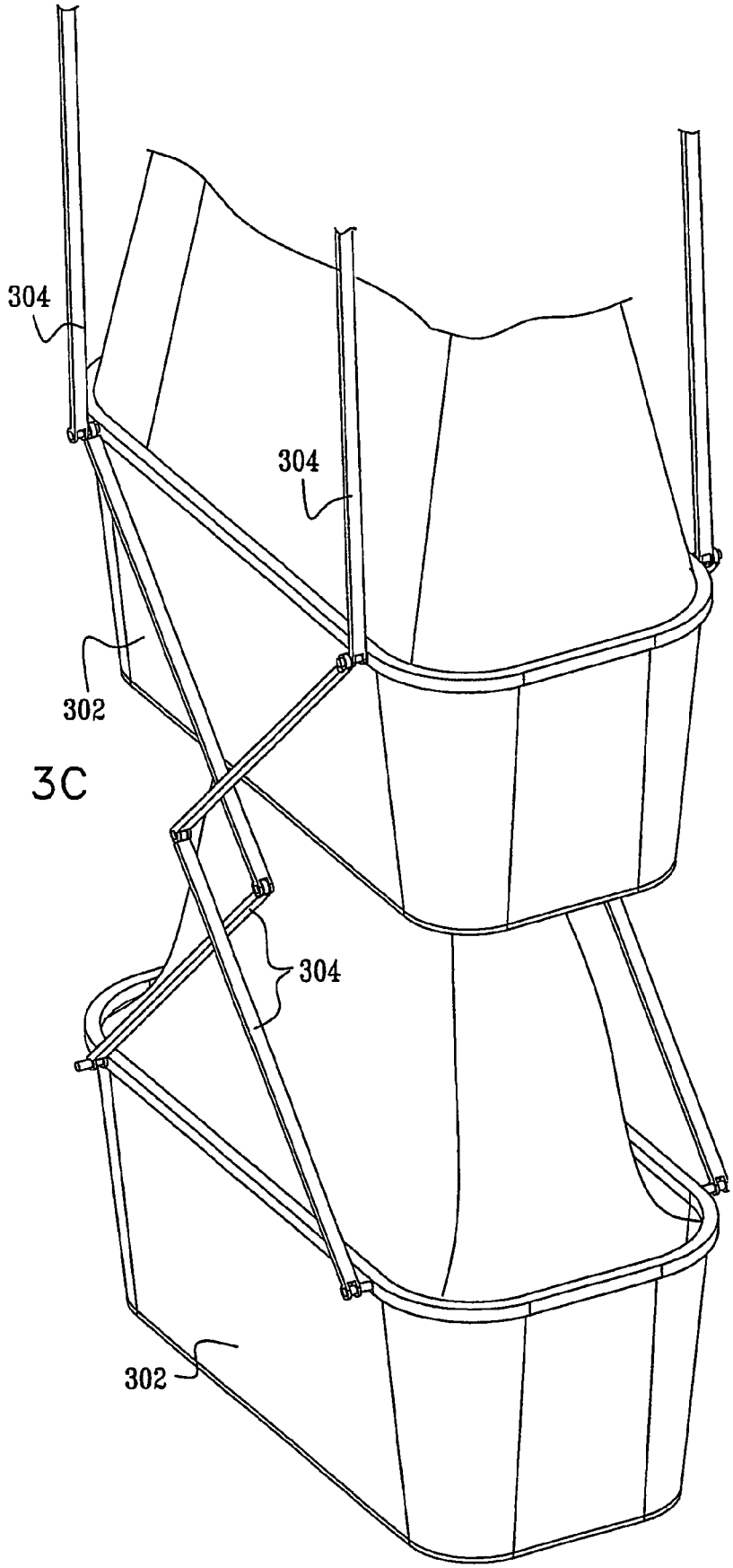

Reference is now made to FIGS. 3A-3C, which illustrate a variation of the structure of FIGS. 1-2W. Here the transporter, designated by reference numeral 300, employs a plurality of mutually nestable cabins 302 which are preferably connected to each other by rigid support elements, such as rigid foldable tension rods 304. Cabins 302 are sequentially lowered, deployed and used, much in the same way as described hereinabove with reference to FIGS. 2A-2W. FIG. 3A corresponds generally to FIG. 2G and shows a similar stage in deployment, FIG. 3B corresponds generally to FIG. 2I and shows a similar stage in deployment and FIG. 3C corresponds generally to a portion of FIG. 2R and shows a partial collapse just prior to nesting of the lowermost two cabins 302. As seen in FIG. 3C, cabins 302 are connected by rigid foldable tension rods 304, which provide generally the same functionality as extensions 220, 222, 224 and 226 (FIG. 2F).

Figure 4A:
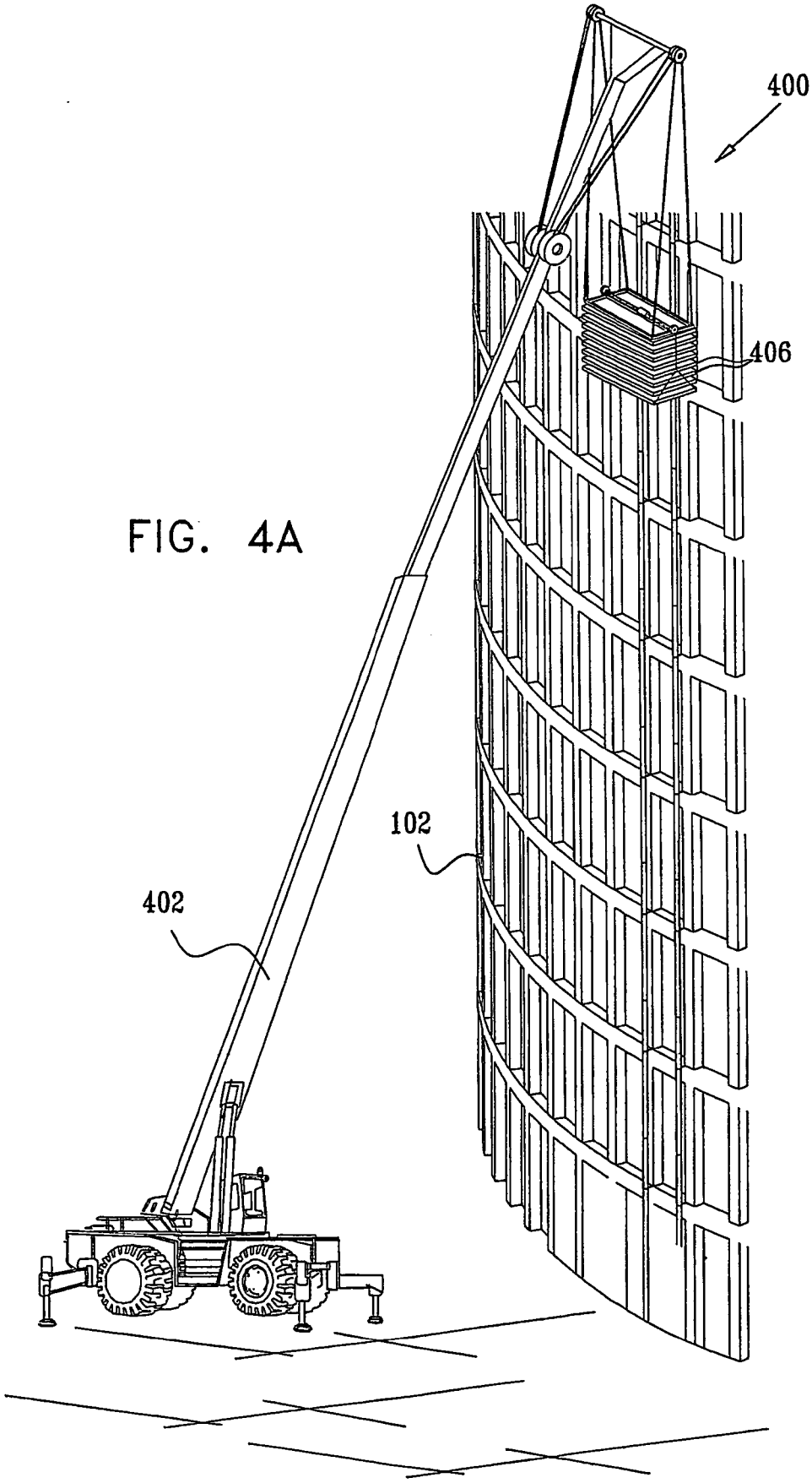
FIGS. 4A and 4B illustrate two stages in the operation of an escape transporter in a further variation of the system of FIGS. 1-3C.
Figure 4B:
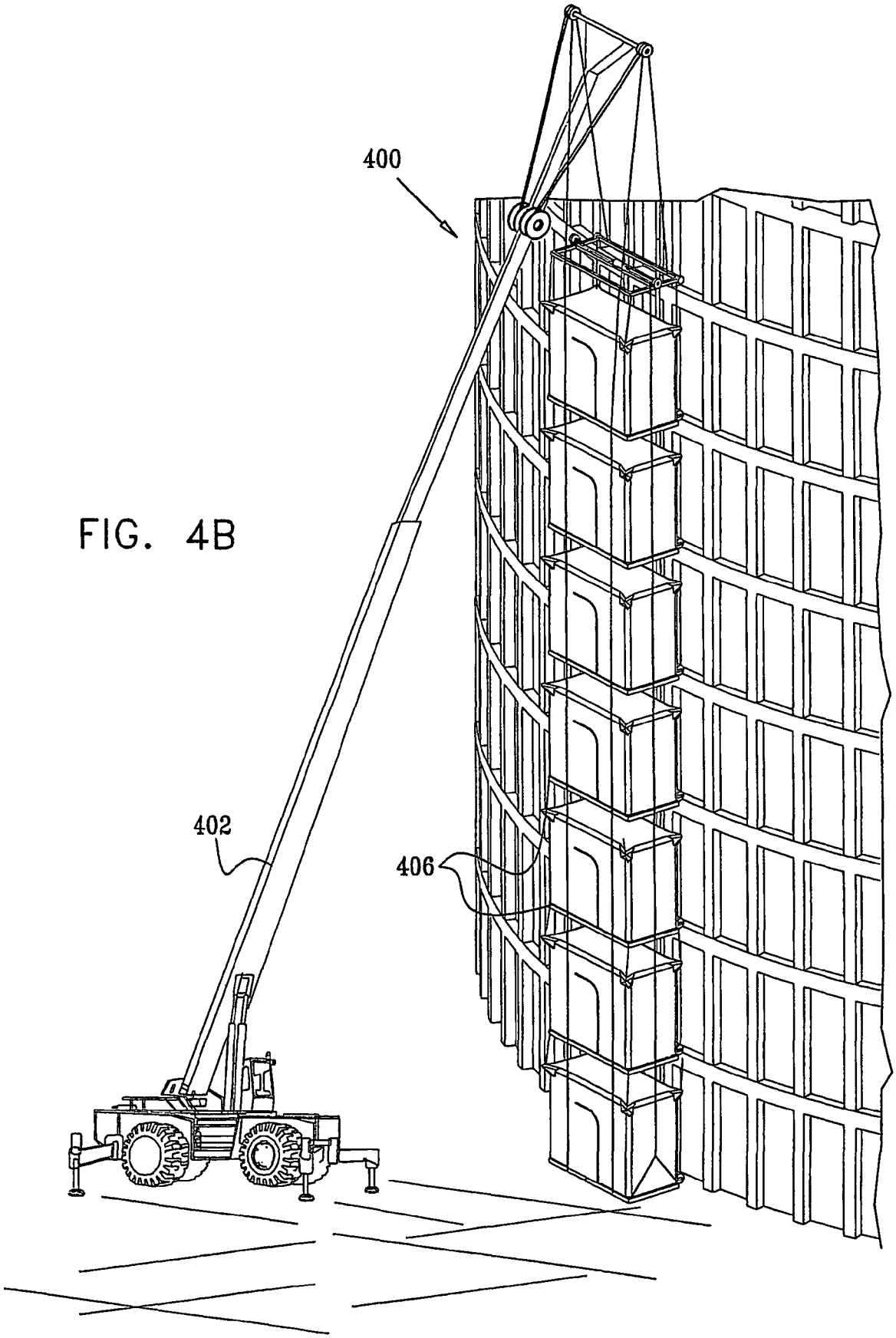

Reference is now made to FIGS. 4A and 4B, which illustrates a further variation of the structure of FIGS. 1-3C. Here the transporter, designated by reference numeral 400, is portable and supported by a moveable crane 402, but is operated in a manner similar to that described hereinabove with reference to FIGS. 2A-2W. Transporter 400 may employ platforms 406 similar to platforms 106 illustrated in FIGS. 1-2W, or alternatively any other suitable structure, such as that illustrated in FIGS. 3A-3C.

Figure 5A:
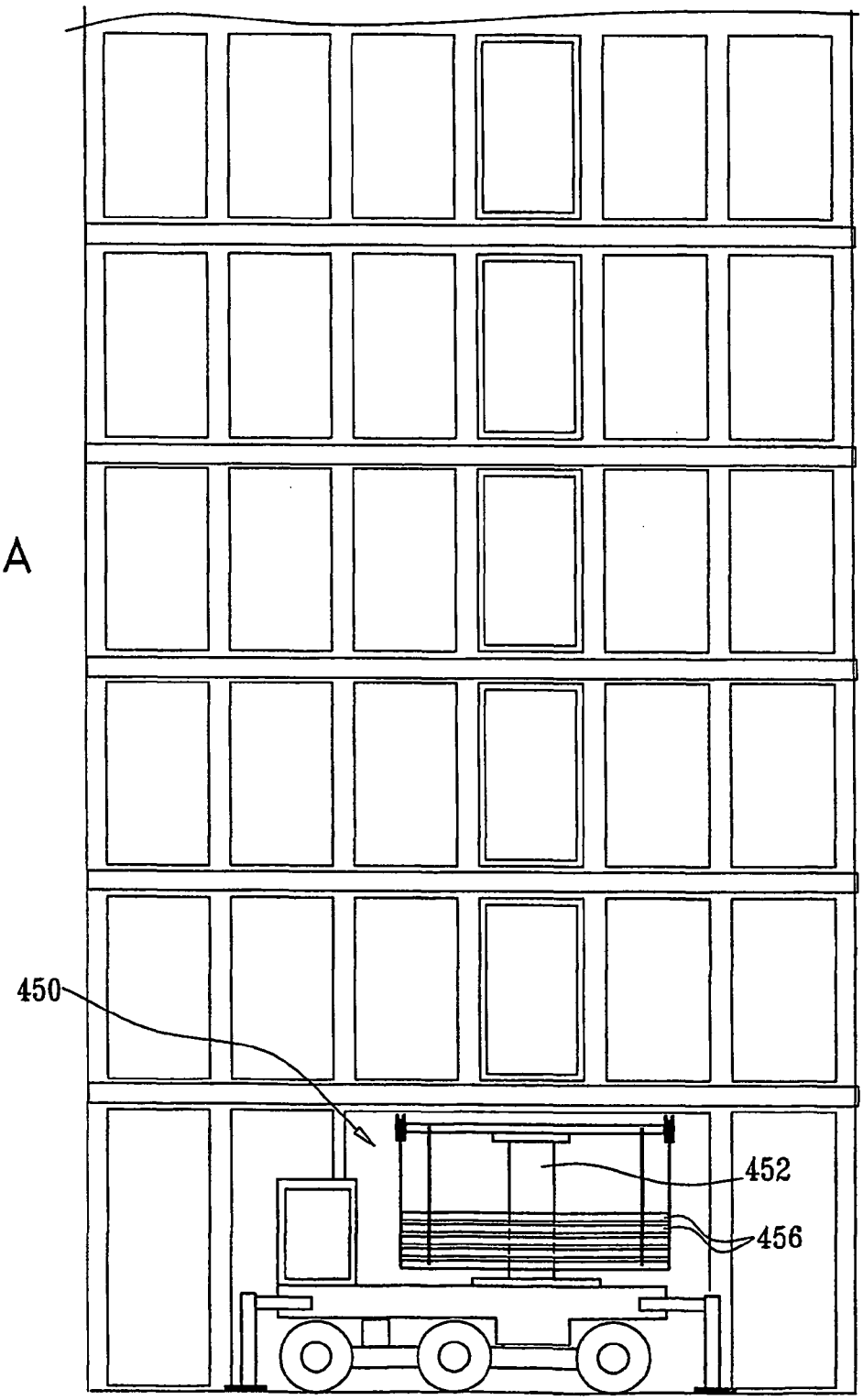
FIGS. 5A, 5B and 5C illustrate three stages in the operation of an escape transporter in an additional variation of the system of FIGS. 1-4B.
Figure 5B:
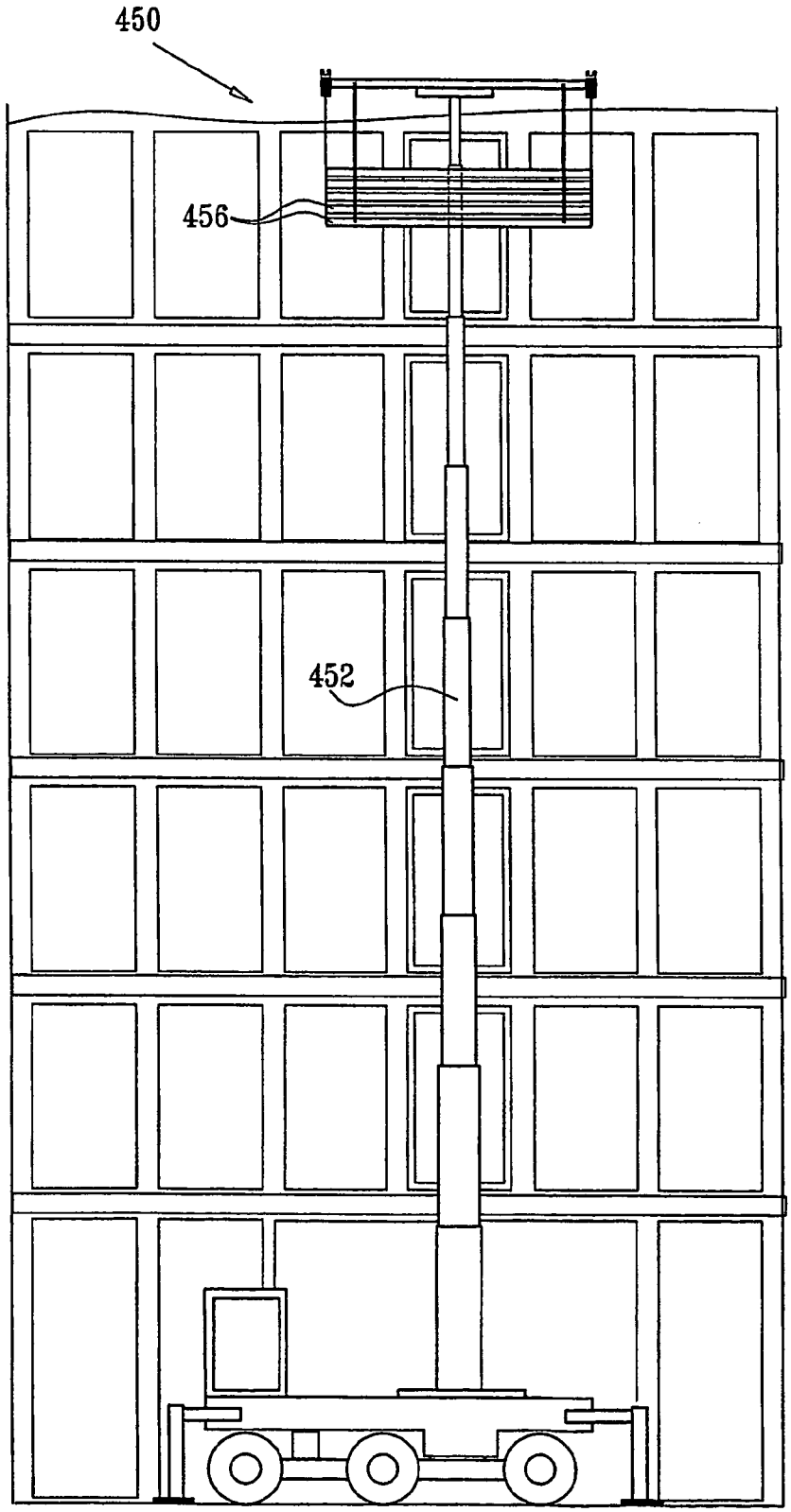
Figure 5C:
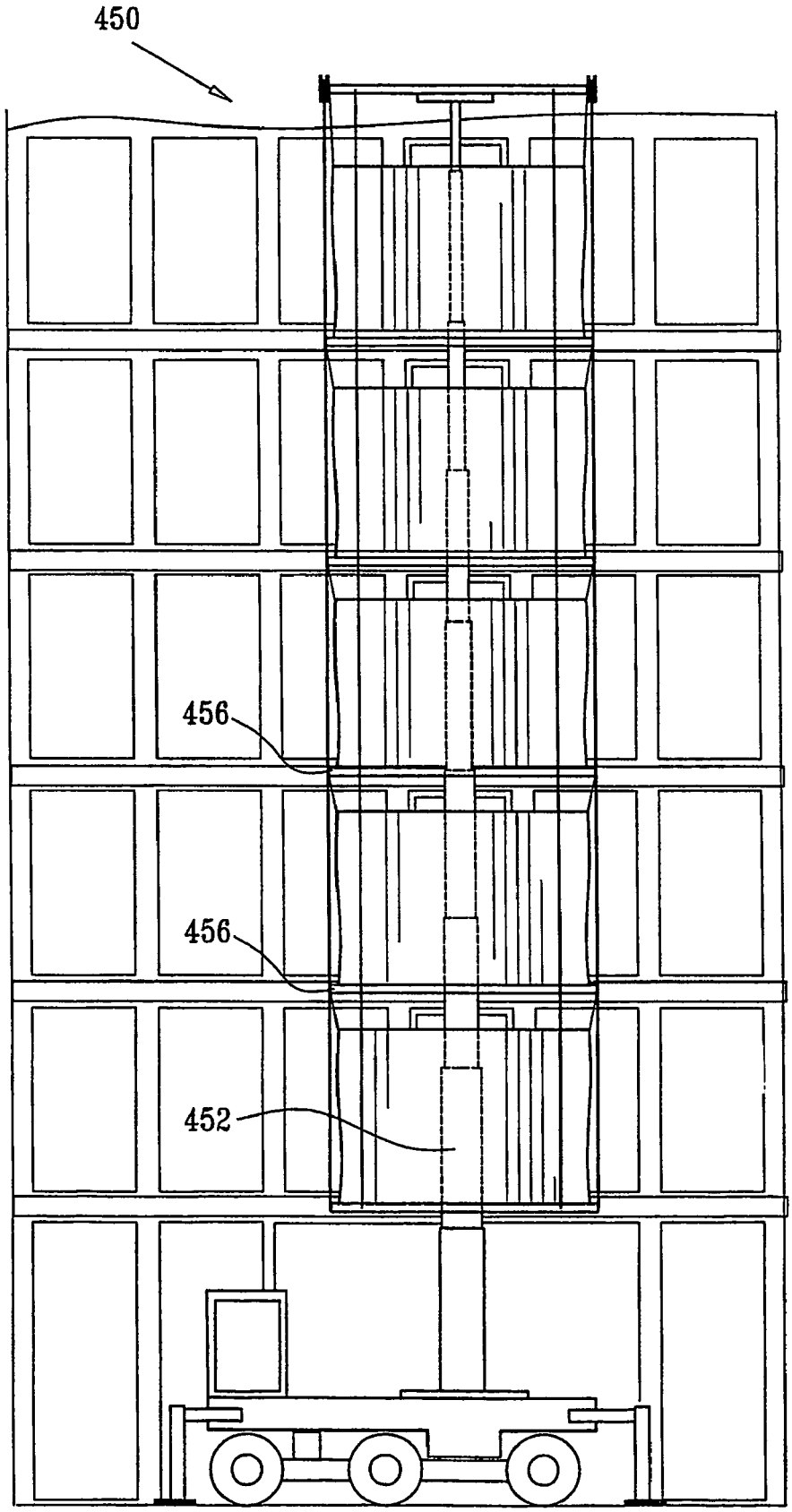

Reference is now made to FIGS. 5A, 5B and 5C, which illustrate three stages in the operation of an escape transporter in an additional variation of the system of FIGS. 1-4B. Here the transporter, designated by reference numeral 450, is portable and supported by a telescopic piston 452, and is operated in a manner similar to that described hereinabove with reference to FIGS. 1-2W. Transporter 450 may employ platforms 456 similar to platforms 106 illustrated in FIGS. 1-2W, or alternatively any other suitable structure, such as that illustrated in FIGS. 3A-3C. FIG. 5A shows a storage orientation and corresponds generally to transporter 110 of FIG. 1. As seen in FIG. 5B, piston 452 raises transporter 450 to the appropriate building level. In this embodiment, telescopic piston 452 performs a similar function to winch/brake assembly 144 of the embodiment of FIGS. 2A-2W. FIG. 5B shows an advanced pre-deployment stage and corresponds generally to transporter 114 of FIG. 1. FIG. 5C shows a fully deployed transporter 450 and corresponds generally to FIG. 2H. It is appreciated that in this embodiment, lowering and collapsing of platforms 456 is achieved by lowering piston 452.

Figure 6:
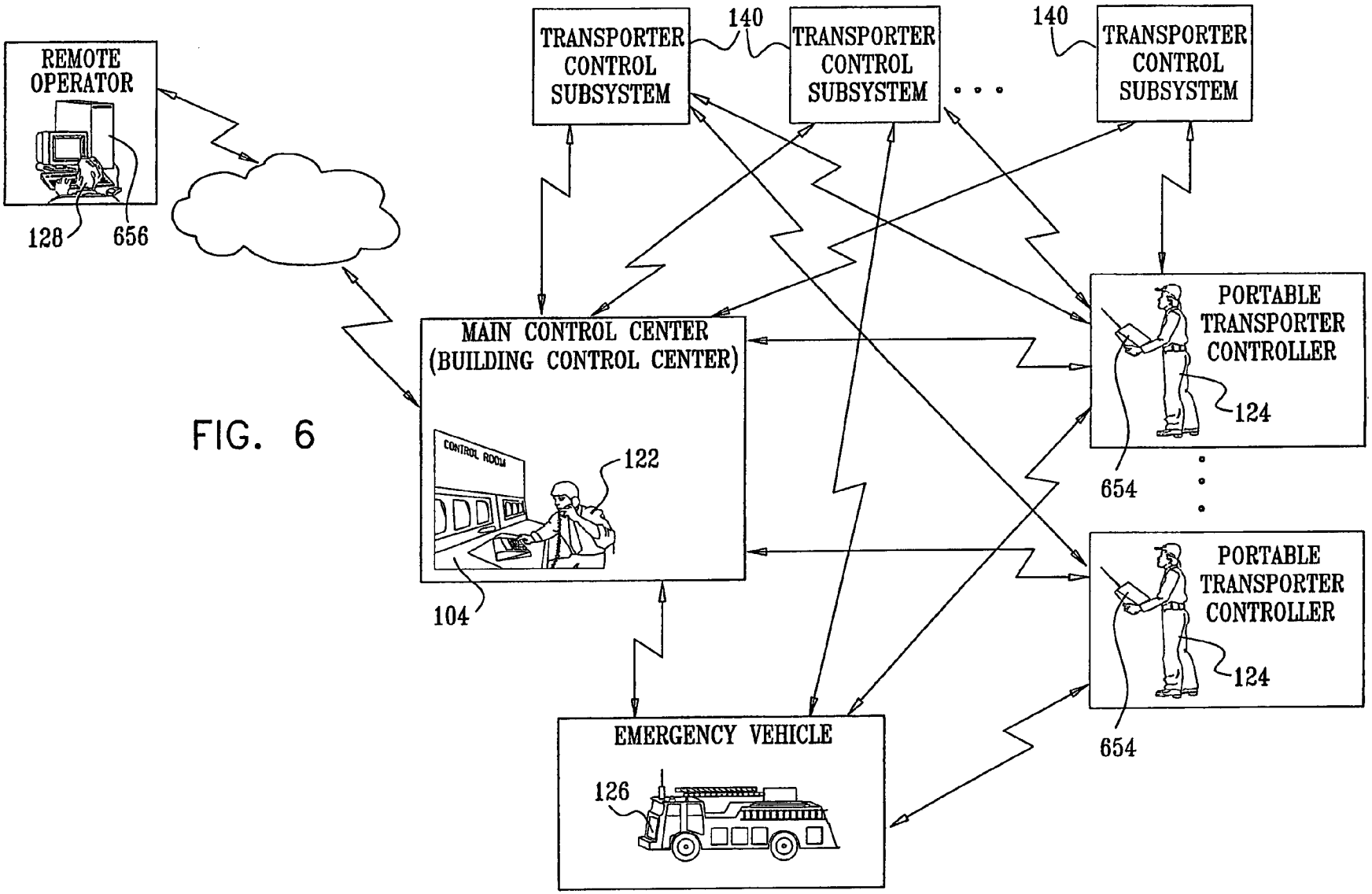
FIG. 6 is a simplified block diagram illustration of a communication and control network useful in the system of FIGS. 1-5C.

Reference is now made to FIG. 6, which is a simplified block diagram illustration of a communications and control network useful in the system of any of FIGS. 1-5C. In a preferred communications and control network, central controller 104, which is preferably housed within building 102 (FIG. 1), has the capability of controlling and monitoring the operation of all of the transporters 100 (FIG. 1) of the building and communicates with transporter control subsystems 140 forming part thereof via multiple communications channels, both wired and wireless. A plurality of portable transporter controllers 654 are preferably provided to enable individual control of each transporter 100 (FIG. 1) by a different evacuation team member, such as operators 122 and 124, who are on the ground or at other appropriate locations. Portable transporter controllers 654 preferably communicate wirelessly both with one or more transporters 100, particularly a transporter 100 assigned thereto. A remotely located operator, such as operator 128, monitoring the situation from a remote location preferably employs a remote communicator 656 for communicating with central controller 104 and/or with portable transporter controllers 654 via a data network, such as the Internet or an emergency network.

It is appreciated that evacuation team leaders located on floors of the building 102 (FIG. 1) or riding on platforms 106 (FIG. 1) of transporters 100 (FIG. 1) may also be in voice or data communication with operators 122 and 124 of controllers 104 and 654 and the operator 128 of communicator 656.

Figure 7:
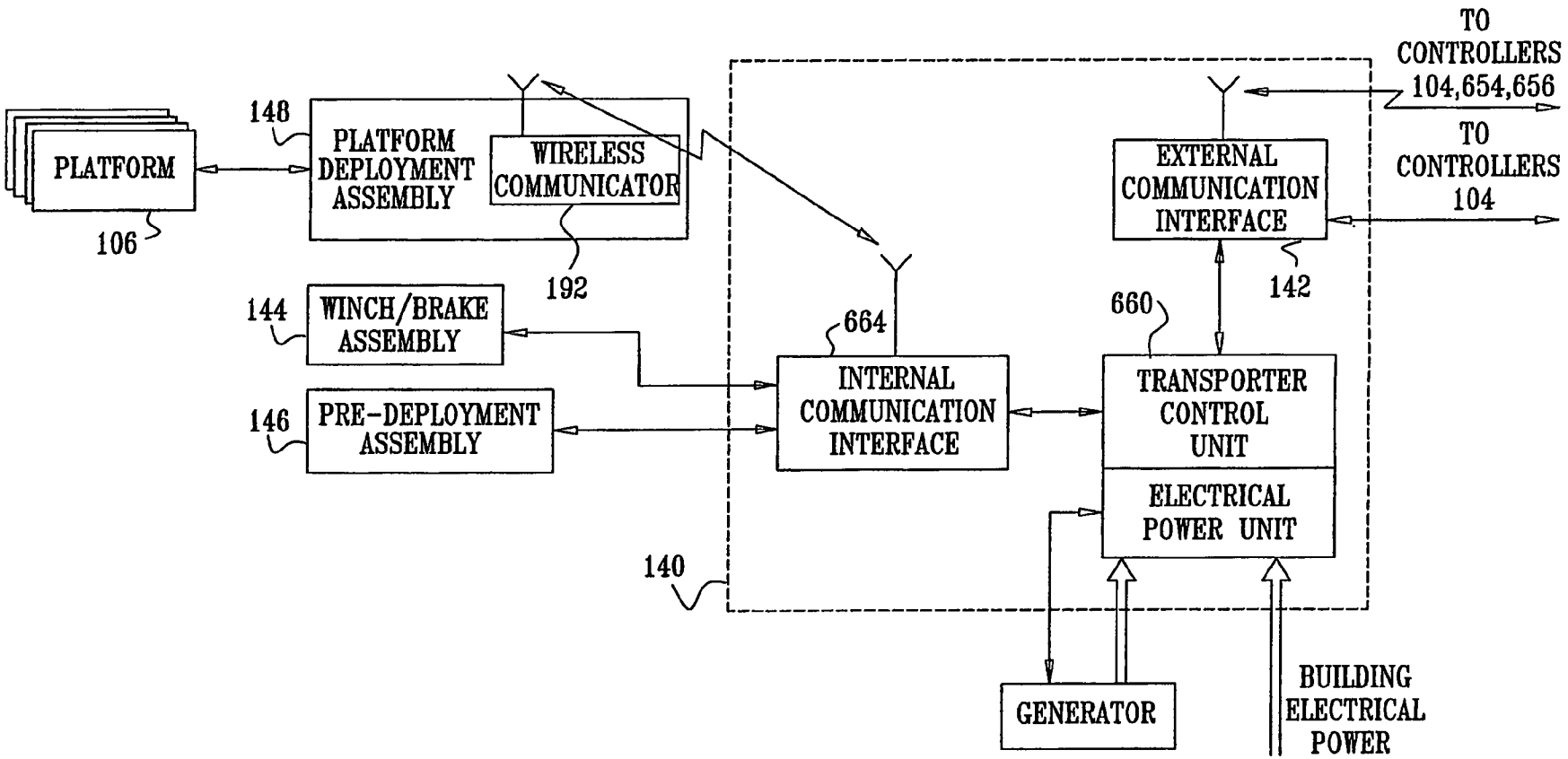
FIG. 7 is a simplified block diagram of part of the system of FIGS. 1-6.

Reference is now made to FIG. 7, which is a simplified block diagram illustration of a transporter control subsystem 140 useful in the systems of any of FIGS. 1-6. As seen in FIG. 7, the transporter control subsystem preferably comprises a transporter control unit 660 with which are associated external communications interface 142 and an internal communications interface 664. The external communications interface 142 provides wired and wireless communications with controller 104 and portable transporter controllers 654 and communicator 656, as appropriate, while the internal communications interface 664 provides wired and wireless communications as appropriate with winch/brake assembly 144, pre-deployment assembly 146 and platform deployment assembly 148, via wireless communicator 192.

Control unit 660, via internal communications interface 664, governs winching and braking operation of winch/brake assembly 144 as well as emergency braking operation of an emergency braking system therein, thereby to position deployed platforms 106 at designated floors and to lower them, when loaded, to an egress location. Pistons 174 (FIG. 2A) of pre-deployment assembly 146 are also operated by control unit 660 via internal communications interface 664 to position the stacked platforms for vertical movement in operative engagement with vertical guides 136 (FIG. 1). Deployment of the platforms 106 by platform deployment assembly 148, including pulleys 198 (FIG. 2A) which unwind cables 200 (FIG. 2A), is also controlled by control unit 660 via wireless communicator 192. Platform deployment assembly 148 is also operative to communicate with sensors and/or circuitry located in platforms 106, either in a wired or wireless communication mode.

It is appreciated that platforms 106 may include multiple sensors that communicate with central controller 104 and/or portable controllers 654 and remote communicator 656 via transporter control subsystem 140. These sensors are operative to provide information about the various deployment stages and may include, for example, speed sensors, platform position sensors, evacuation bridge position sensors, ground proximity sensors and weight sensors, preferably for determining when platforms are empty.

Figure 8A:
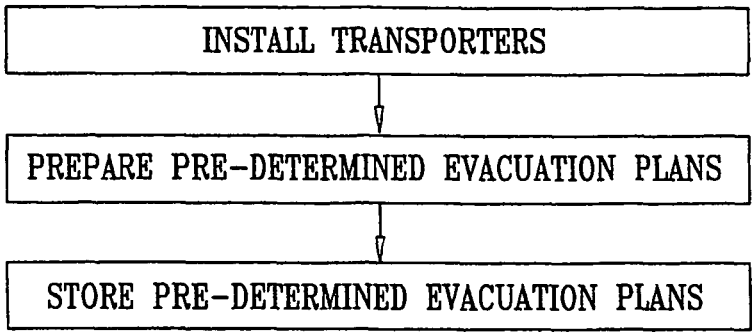
FIGS. 8A, 8B, 8C, 8D, 8E and 8F are flow charts which illustrate operation of various parts of the system of FIGS. 1-3C.

Reference is now made to FIGS. 8A-8F, which are simplified flow charts illustrating operation of the system of FIGS. 1-3C. As seen in FIG. 8A, upon installation of the evacuation system, a plurality of pre-determined evacuation contingency plans are prepared and stored. A typical pre-determined plan calls for transporter 110 to be used for evacuation of floors 44-50, transporter 112 to be used for evacuation of floors 37-43 and so on. These plans are preferably accessible to controller 104, portable controllers 654 and remote communicator 656.

Figure 8B:
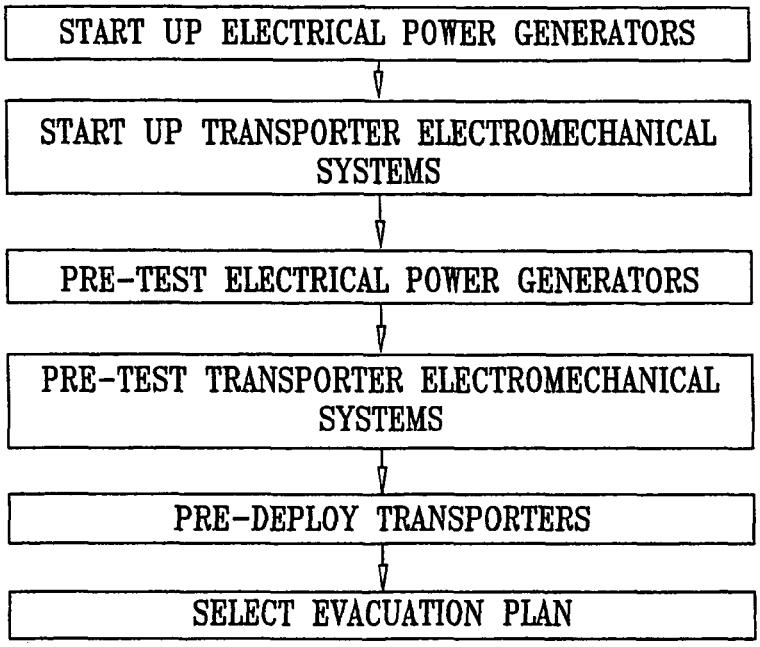

Prior to issuance of an evacuation standby order, the transporters 100 are each preferably in an orientation as shown in FIG. 2A. As shown in FIG. 8B, upon issuance of an evacuation standby order, electrical power generators and the electromechanical systems of the transporters 100 are started up and pre-tested and the transporters 100 are preferably pre-deployed to their orientation as seen in FIG. 2C.

Preferably simultaneously, either one of the pre-determined evacuation plans is adopted or a custom evacuation plan is decided upon by an authorized operator.

Figure 8C:
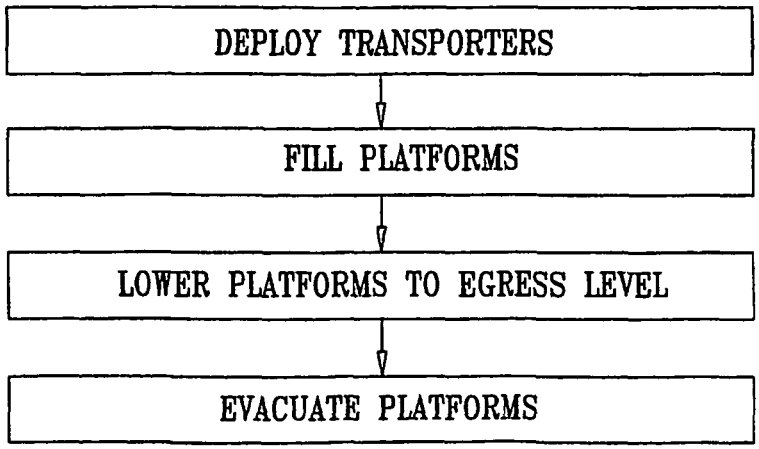

FIG. 8C is a simplified flow chart showing an overview of the operation of the system described hereinabove. As seen in FIG. 8C, a deployment order is given by an authorized operator for one or more transporters 100, based on the evacuation plan which is in force. Upon receipt of a deployment order, control unit 660 of each transporter 100 is operative to deploy transporters 100 to the building level required by the evacuation plan, as described hereinbelow with reference to FIG. 8D. Following deployment of the transporter 100, platforms 106 are filled with evacuees, as described hereinbelow with reference to FIG. 8E. Finally, the filled platforms are lowered to an egress level and emptied as described hereinbelow with reference to FIG. 8F.

Figure 8D:
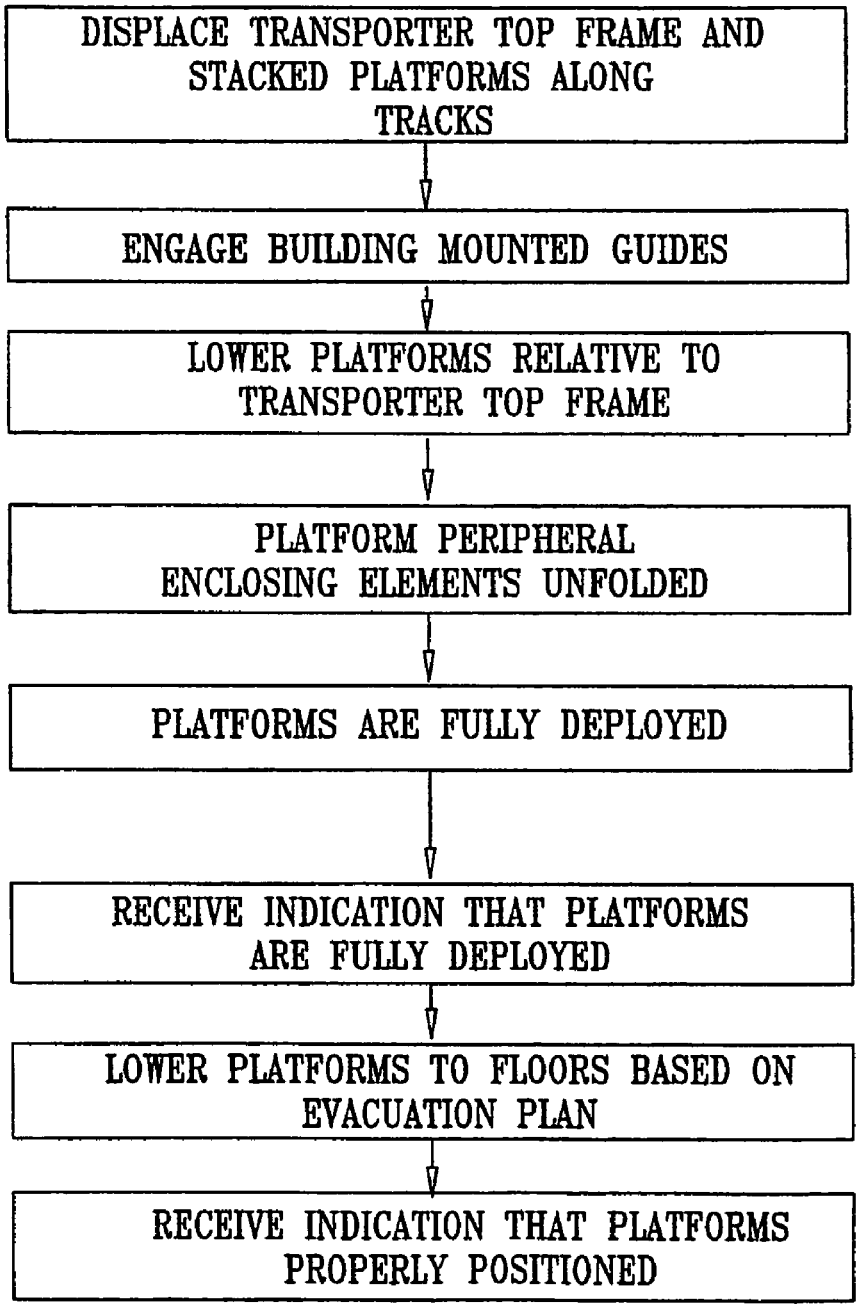

Referring now to FIG. 8D, each transporter preferably undertakes the following sequence of operations, which preferably occur automatically. As seen in FIGS. 2D and 2E, transporter top frame 158 and stacked platforms 106 are laterally and downwardly vertically displaced along tracks 176. Building mounted guide riding roller assemblies 204 engage vertical guides 136.

Subsequently, as seen in FIG. 2F, platforms 106 are lowered relative to transporter top frame 158 by unwinding of cables 200 from pulleys 198 by action of motor/brake assembly 194. As further seen in FIG. 2F, following further lowering of platforms 106 relative to transporter top frame 158, unfolding of peripheral enclosing elements 134 (FIG. 1) associated with each platform 106 takes place, as the peripheral enclosing elements 134 are each pulled upward by a plurality of tensioning lines 210 which are connected to transporter top frame 158. Extensions 220, 222, 224 and 226 of respective cables 150, 152, 154 and 156 which interconnect the transporter top frame 158 with the platform 106 lying therebelow and interconnect the platforms with each others become taut and support the platforms and define the spacing therebetween.

As seen in FIG. 2G, when the platforms 106 of a transporter 100 are fully deployed, the peripheral enclosing elements 134 of each platform 106 are fully tensioned. Preferably, the central controller 104 and portable controllers 654 receive indications from appropriate sensors that the platforms are fully deployed.

Following full deployment of the platforms of a transporter, the platforms are lowered to each be aligned with a building floor based on the evacuation plan which is currently in force, as seen in FIG. 2H. Preferably, the central controller 104 and portable controllers 654 receive indications from appropriate sensors that the platforms are properly positioned at the correct building floors.

Figure 8E:
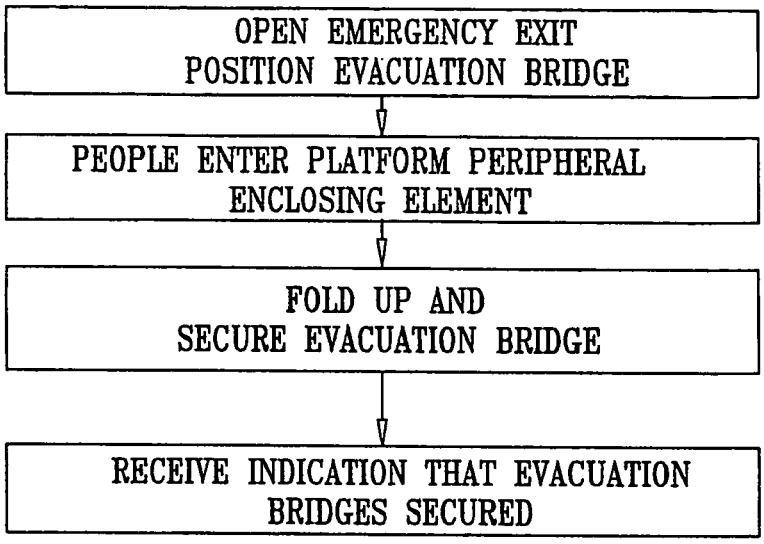
Figure 8F:
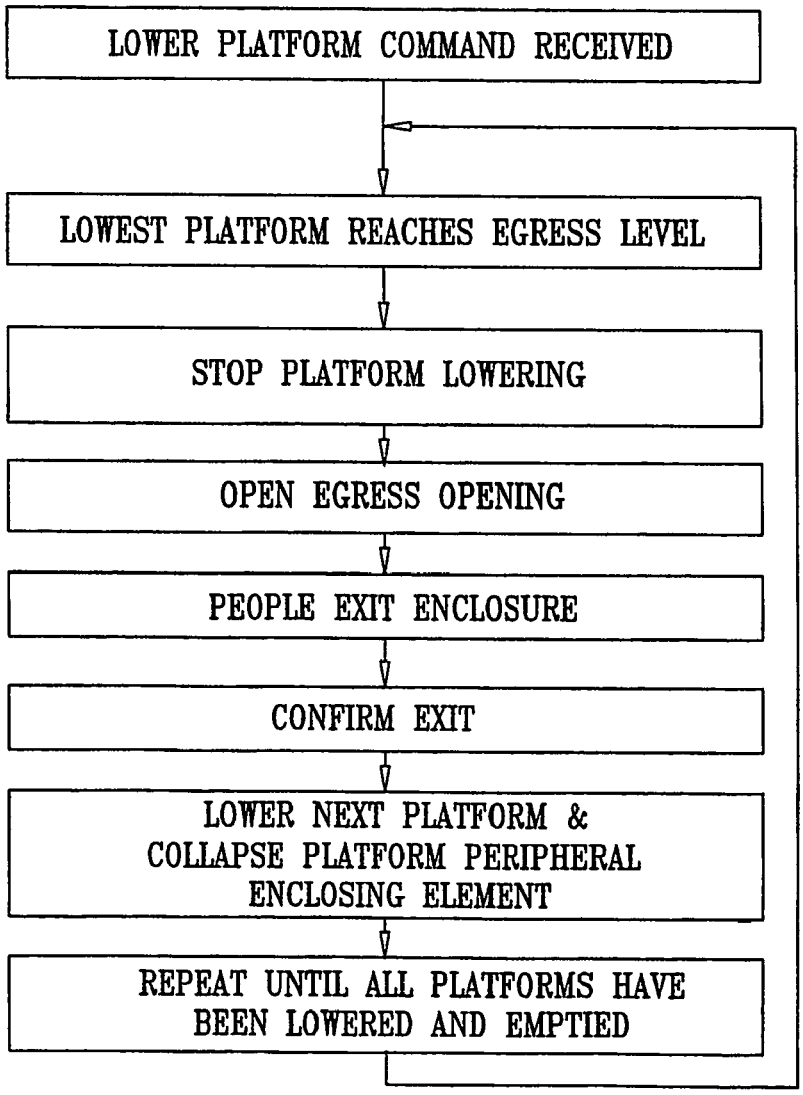

FIG. 8E is a simplified flow chart showing the steps that preferably are taken simultaneously on each floor of the building at which a platform 106 is present. These operations are preferably coordinated by an evacuation team leader located on each floor.

The evacuation team leader preferably opens an emergency exit, such as emergency door 238. The evacuation team leader preferably employs evacuation emergency key 240 to open emergency evacuation door 238 and positions the evacuation bridge 206 so as to permit access to the interior of the peripheral enclosing element 134 on the platform 106 as seen in FIGS. 2J, 2K and 2L.

People cross bridge 206 and fill the interior of peripheral enclosing element 134 on platform 206 as shown in FIG. 2M and then the evacuation team leader folds up the evacuation bridge 206 and secures it to the peripheral enclosing element 134 to serve as a security gate, as seen in FIG. 2N. Preferably, the central controller 104 and portable controllers 654 receives an indication from appropriate sensors that the evacuation bridges 206 are all secured and that the platforms are ready to be lowered.

Upon receipt of the aforesaid indication, the central controller 104 or portable controller 654 provide a lower platforms command to control unit 660. Control unit 660 automatically lowers the platforms as seen in FIG. 2P to the egress level 108 preferably in a series of automatic operations, indicated in FIG. 8F, as follows:

When the lowest platform 106 reaches the egress level 108, lowering of the platforms is temporarily interrupted in response to a signal from an appropriate sensor. At this stage, for example, the zippered egress opening 230 is opened from inside the enclosure 134 by the team leader or from outside the enclosure by authorized personnel and people leave the enclosure. FIGS. 2Q and 2R illustrate egress of evacuees from a lowest platform 106 of a transporter and subsequent collapse of the peripheral enclosing element 134 surrounding the lowest platform 106, as the lowering of the platforms is resumed following exit of all people therefrom. Exit of all people from a platform before collapse of its peripheral enclosing element 134 is preferably confirmed by a suitable sensor and also by authorized personnel. Each subsequent platform is lowered to the egress level and the people therein leave the enclosing element 134 and the platforms are stacked in a collapsed orientation. FIG. 2S shows egress of evacuees from the highest platform. It is appreciated that the operations of lowering the platforms, permitting egress of the people therein and collapsing of the platforms and their enclosures may alternatively be carried out under manual control, by an authorized operator or, as a further alternative, be carried out under partially automatic and partially manual control.

It is appreciated that at this stage, the transporter 100 may be employed for raising rescue personnel or firefighters to selected floors of building 102, as shown in FIGS. 2V and 2W. This series of operations is preferably carried out under manual control, by an authorized operator or under partially automatic and partially manual control. In this series of operations many of the steps referred to above are carried out generally in an opposite order.

It is appreciated that authorized operator intervention may take place at one or more stages of the operation described hereinabove.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

The invention claimed is:

1. An evacuation system for a building comprising:

at least one lowerable, multiple-platform, generally vertical transporter arranged for selectable communication with multiple floors of a building for simultaneous loading of persons onto multiple platforms of said transporter from said multiple floors; and a controller operative to position said multiple platforms at said multiple floors for simultaneous loading of said persons onto said multiple platforms of said transporter from said multiple floors and operative to subsequently lower said multiple platforms of said at least one transporter, when loaded with said persons, from said multiple floors to at least one egress level at which egress of said persons may safely occur.

2. An evacuation system according to claim 1 and wherein said at least one lowerable, multiple-platform, generally vertical transporter comprises:

a plurality of stackable platforms arranged to be supported on multiple generally vertical supports, at least some of said plurality of stackable platforms being arranged in mutually spaced relationship, each in communication with a different floor of said building for evacuation loading.

3. An evacuation system according to claim 2 and wherein said plurality of stackable platforms are arranged in a mutually collapsed relationship when not in use.

4. An evacuation system according to claim 2 and wherein said plurality of stackable platforms are arranged in a mutually collapsed relationship following evacuation unloading.

5. An evacuation system according to claim 2 and wherein said multiple generally vertical supports comprise cables.

6. An evacuation system according to claim 2 and wherein said multiple generally vertical supports comprise rigid support elements.

7. An evacuation system according to claim 2 and wherein said plurality of stackable platforms each comprise a bottom support surface and a peripheral enclosing element.

8. An evacuation system according to claim 7 and wherein said peripheral enclosing element comprises a wall element formed of fabric.

9. An evacuation system according to claim 8 and wherein said fabric comprises at least one of a heat resistant fabric, a fire resistant fabric and a smoke resistant fabric.

10. An evacuation system according to claim 1 and also comprising at least one building mounted stabilizing element cooperating with said transporter for stabilizing said transporter against lateral forces.

11. An evacuation system according to claim 1 and wherein:

said at least one transporter comprises a plurality of transporters; and said controller is operative to individually control individual ones of said plurality of transporters wherein multiple platforms of different transporters may be simultaneously positioned in communication with different groups of multiple floors of said building for simultaneous evacuation loading.

12. An evacuation system according to claim 1 and wherein:

said controller is operative to simultaneously position said multiple platforms in communication with multiple egress levels of said building for simultaneous evacuation.

13. An evacuation system according to claim 1 and wherein said at least one transporter is also operative for lifting persons from said at least one egress level to said multiple floors of said building.

14. An evacuation system according to claim 1 and wherein said multiple platforms comprise nestable platforms.

15. An evacuation system according to claim 1 and wherein said transporter is building mounted.

16. An evacuation system according to claim 15 and wherein said controller is operative to selectably lower said at least one transporter to said at least one egress level in the absence of electrical power.

17. A method for evacuation of a building comprising:

positioning at least one lowerable, multiple-platform, generally vertical transporter in communication with multiple floors of a building for simultaneous loading of persons onto multiple platforms of said transporter from said multiple floors; and lowering said multiple platforms of said at least one transporter, when loaded with said persons, from said multiple floors to at least one egress level at which egress of said persons may safely occur.

18. An evacuation method according to claim 17 and wherein said positioning comprises selectably positioning a plurality of stackable platforms, each in communication with a different floor of said building, for evacuation loading.

19. An evacuation method according to claim 17 and also comprising stabilizing said transporter against lateral forces.

20. An evacuation method according to claim 17 and wherein:

said at least one transporter comprises a plurality of transporters; and said positioning comprises simultaneously positioning individual ones of said plurality of transporters wherein multiple platforms of different transporters are in communication with different groups of multiple floors of said building for simultaneous evacuation loading.

21. An evacuation method according to claim 17 and also comprising simultaneously positioning said multiple platforms in communication with multiple egress levels of said building for simultaneous evacuation.

22. A method for evacuation of a building comprising:

positioning at least one lowerable, mutually spacable, multiple-platform, generally vertical transporter in communication with multiple floors of a building for simultaneous loading of persons onto multiple platforms of said transporter from said multiple floors; and lowering said multiple platforms of said at least one transporter, when loaded with said persons, from said multiple floors to at least one egress level at which egress of said persons may safely occur; and reducing mutual spacing between said multiple platforms following said egress of said persons.

23. An evacuation method according to claim 22 and also comprising stabilizing said transporter against lateral forces.

24. An evacuation method according to claim 22 and wherein:

said at least one transporter comprises a plurality of transporters; and said positioning comprises simultaneously positioning individual ones of said plurality of transporters wherein multiple platforms of different transporters are in communication with different groups of multiple floors of said building for simultaneous evacuation loading.

25. An evacuation system according to claim 22 and also comprising simultaneously positioning said multiple platforms in communication with multiple egress levels of said building for simultaneous evacuation.

26. A method for simultaneously lifting people to multiple levels of a building comprising:

positioning at least one liftable, multiple-platform, generally vertical transporter in communication with at least one ingress level of a building for loading of persons onto multiple platforms of said transporter from said at least one ingress level; and lifting said multiple platforms of said at least one transporter, when loaded with said persons, to multiple floors of said building for simultaneous unloading of persons from said multiple platforms of said transporter to said multiple floors.

27. A method according to claim 26 and wherein said positioning comprises sequentially positioning a plurality of stackable platforms, each in communication with said ingress level.

28. A method according to claim 26 and also comprising stabilizing said transporter against lateral forces.

29. A method according to claim 26 and also comprising simultaneously positioning said multiple platforms in communication with multiple ingress levels of said building for simultaneous loading.

* * * * *